US008443819B2

(12) United States Patent
Beaulieu

(10) Patent No.: US 8,443,819 B2
(45) Date of Patent: May 21, 2013

(54) UMBRELLA SUPPORT ASSEMBLY

(75) Inventor: Peter John Beaulieu, New Smyrna Beach, FL (US)

(73) Assignee: Oceanz LLC, New Smyrna Beach, FL (US)

( * ) Notice: Subject to any disclaimer, the term of this patent is extended or adjusted under 35 U.S.C. 154(b) by 0 days.

(21) Appl. No.: 13/024,185

(22) Filed: Feb. 9, 2011

(65) Prior Publication Data

US 2011/0174349 A1 Jul. 21, 2011

Related U.S. Application Data

(62) Division of application No. 12/615,760, filed on Nov. 10, 2009.

(60) Provisional application No. 61/216,229, filed on May 14, 2009.

(51) Int. Cl.
*A45B 25/00* (2006.01)

(52) U.S. Cl.
USPC ..... 135/32; 135/29

(58) Field of Classification Search
USPC ..... 135/32, 29, 31, 28
See application file for complete search history.

(56) References Cited

U.S. PATENT DOCUMENTS

| | | | | | |
|---|---|---|---|---|---|
| 929,536 | A * | 7/1909 | Babbit | 135/32 |
| 2,160,231 | A * | 5/1939 | Schaefer | 135/26 |
| 2,385,575 | A * | 9/1945 | Sol Isler | 135/29 |
| 3,424,180 | A * | 1/1969 | Andolfi | 135/28 |
| 5,193,566 | A * | 3/1993 | Chen | 135/28 |
| 5,433,233 | A * | 7/1995 | Shiran et al. | 135/20.1 |
| 6,386,214 | B1 * | 5/2002 | Clarke | 135/20.3 |
| 6,397,866 | B1 * | 6/2002 | You | 135/23 |
| 6,920,887 | B2 * | 7/2005 | Lo | 135/32 |
| 7,614,413 | B1 * | 11/2009 | Ma | 135/32 |
| 2003/0010367 | A1 * | 1/2003 | Ko | 135/32 |
| 2007/0034242 | A1 * | 2/2007 | Chuang | 135/30 |
| 2007/0209691 | A1 * | 9/2007 | Lin | 135/32 |

* cited by examiner

*Primary Examiner* — Noah Chandler Hawk
(74) *Attorney, Agent, or Firm* — Michael L. Leetzow, P.A.

(57) ABSTRACT

An umbrella assembly and various embodiments of hub assemblies which provide an umbrellas assembly which is easy to install or remove, is extremely rigid, and is capable of withstanding high wind gusts and other high external forces. A first hub assembly includes a mounting bracket having extended regions for mounting to a hub. A second hub assembly includes securing rings for securely binding mounting brackets to a hub. A third hub assembly includes a mortise-tenon mounting bracket. A fourth hub assembly includes securing rings for securely binding mortise-tenon mounting brackets to a hub. A rib center joint connector having stops is presented. A rotatable fabric connector having a plurality of curved surfaces on the head of the fabric connector is present.

14 Claims, 33 Drawing Sheets

UMBRELLA SUPPORT ASSEMBLY

This application is a divisional application of U.S. patent application Ser. No. 12/615,760, filed on Nov. 10, 2009, entitled "Umbrella Support Assembly," which claims priority to Provisional Application No. 61/216,229 filed May 14, 2009, the contents of all of which are incorporated herein by reference.

FIELD OF THE INVENTION

The present invention is related to an umbrella assembly.

BACKGROUND OF THE INVENTION

Umbrellas provide users protection against the environment and can range from small handheld umbrellas to large industrial sized umbrellas which may exceed 11 feet in radius. The instant invention generally relates to (but is not limited to) large industrial type umbrellas which are 5 feet in diameter or more such as patio umbrellas.

These industrial umbrellas are often used in environments where there is high wind or wind gusts and therefore the umbrellas must be both strong and durable. Often these umbrellas are left onsite indefinitely and continually endure a variety of weather conditions which creates wear on the umbrellas. Maintenance and support of these industrial umbrellas requires replacement of worn and broken elements as needed. The durability of the umbrella as well as the ease of maintenance and support are key aspects of the usefulness of the umbrella. Other important aspects of the umbrella include the umbrella aesthetics as well as accessories attachable or integrated into the umbrella.

The ease of operation of the umbrella is another critical factor in selection of an umbrella and key components which effect the operation of the umbrella include the umbrella hub assembly, the umbrella ribs, the joints interconnecting the ribs and the hub, the fabric covering the umbrella ribs, and (optionally) a pulley system to aid in opening and closing the umbrella assembly.

Additionally an umbrella system may further include a unique base or stand for supporting the umbrella assembly and the umbrella system may include accessories such as lighting components.

Overall, an umbrella assembly is only as strong as its weakest link! Largely, umbrella system retailers, commercial/industrial users, and umbrella system equipment manufacturers select and rate umbrellas on their durability and maintainability. The key components listed above are often essential factors in the determination of an umbrella's suitability for use in a particular environment and for a particular customer.

A variety of patents and patent publications disclose umbrella assemblies which provide unique hubs and key elements for pivotally connecting umbrella assembly ribs to other umbrella assembly components or for interconnecting umbrella assembly components. These include (U.S. Pat. No. 7,556,051, U.S. Pat. No. 7,533,680, U.S. Pat. No. 7,111,954), and Patent Application Publications (US 20080202570, US 20070062565, US 20070056615). Particularly, patents exist which teach methods for securing mounting brackets to an umbrella hub. For example, U.S. Pat. No. 7,318,444 provides a hub assembly having upper and lower portion ledges which abut a hub channel in which a bracket band is seated where upper and lower ledges provide a mounting bracket holding force created by squeezing against the periphery of the bracket band. Also, various patents provide limited solutions for securing for securing mounting brackets to an umbrella hub such as the use of a screw inserted into the center of strut bracket members (U.S. Pat. No. 7,293,573, U.S. Pat. No. 6,889,699, U.S. Pat. No. 6,386,214, U.S. Pat. No. 6,314,976).

These patents often sacrifice ease of bracket installation and replacement over hub/bracket assembly combination strength and rigidity.

A need exists for a hub assembly and mounting bracket combination which is both easy to install or remove and which is extremely rigid and capable of withstanding high wind gusts and other high external forces.

SUMMARY OF THE INVENTION

The present invention presents an umbrella support apparatus which includes a hub assembly and various embodiments of alternative hub assemblies which provide an umbrella assembly which is easy to install or remove, is extremely rigid, and is capable of withstanding high wind gusts and other high external forces.

A first hub assembly embodiment is presented which generally includes a mounting bracket having extended regions for mounting to a hub.

A second hub assembly embodiment is presented which generally includes securing rings for securely binding mounting brackets to a hub.

A third hub assembly embodiment is presented which generally includes a mortise-tenon mounting bracket.

A fourth hub assembly embodiment is presented which generally includes securing rings for securely binding mortise-tenon mounting brackets to a hub.

A rib center joint connector which generally includes stops is presented.

A rotatable fabric connector is presented which generally includes a plurality of curved surfaces on the head of the fabric connector.

DETAILED DESCRIPTION

Figure 1:
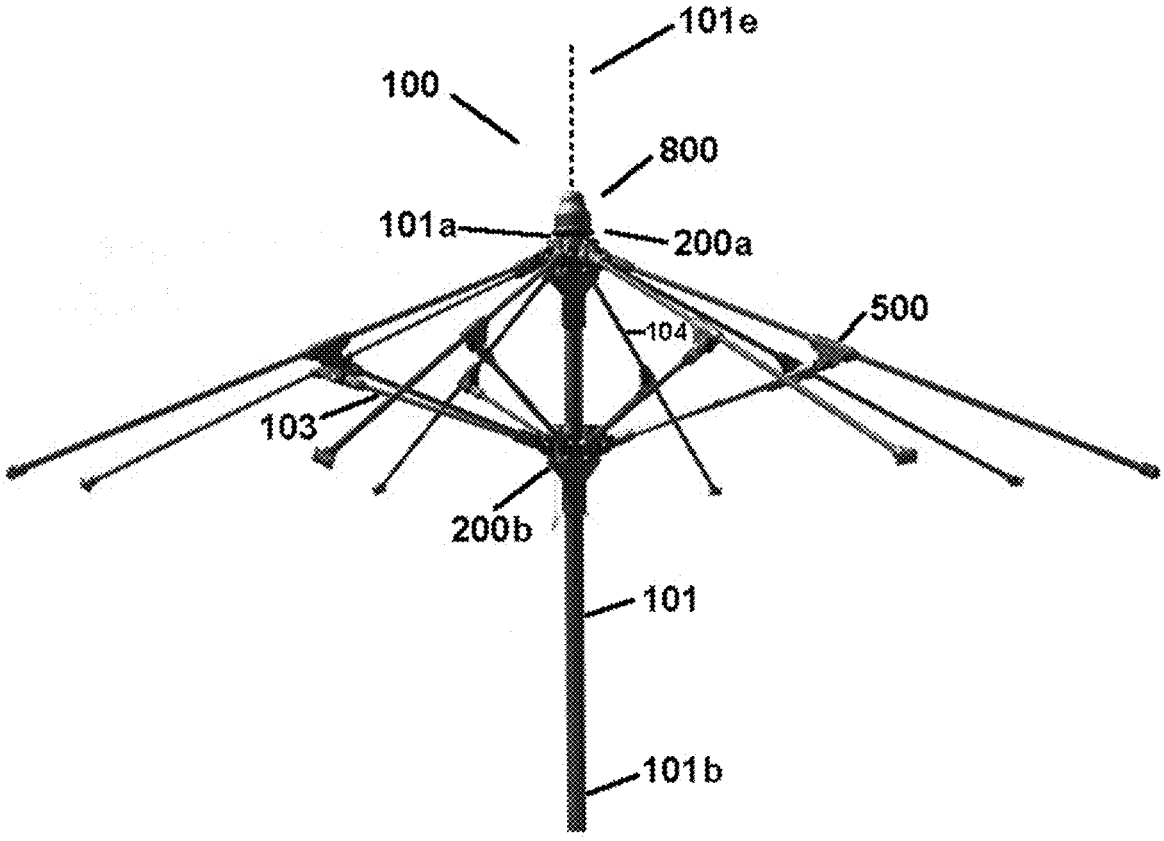
FIG. 1 shows the general components of the umbrella support apparatus in an open position.
Figure 2:
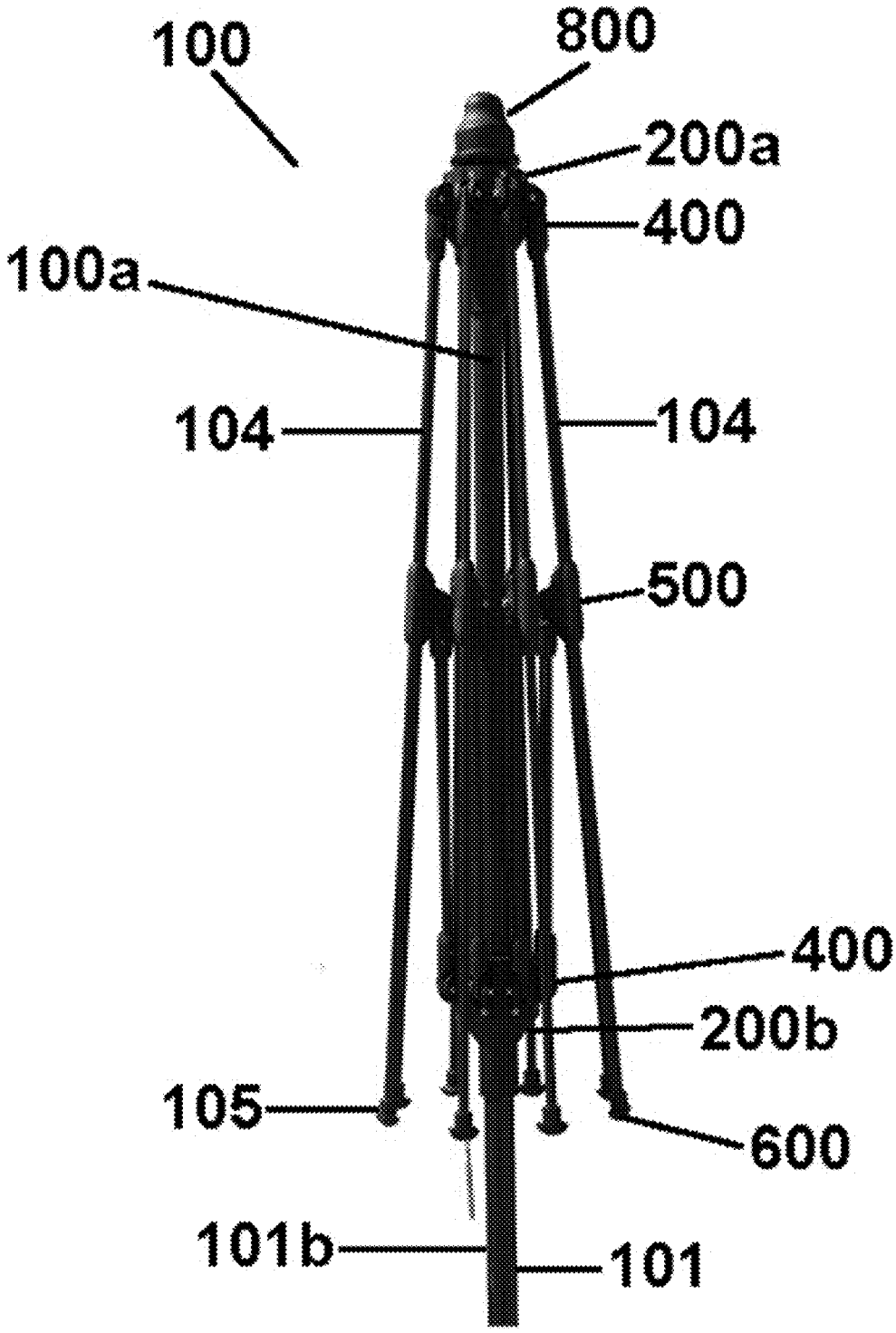
FIG. 2 shows the general components of the umbrella support apparatus in a closed/stored position.

The umbrella assembly 100 (also referred to herein as an umbrella support apparatus) of the preferred embodiment of the instant invention, as shown in FIGS. 1 through 33, presents an umbrella assembly (100) generally comprising a pole (101), a finial stem guide (700), a finial cap (800), a first hub assembly (200*a*), first mounting brackets (300*a*), a second hub assembly (200*b*), second mounting brackets (300*b*), lower ribs (103), eyelet connectors (400), upper ribs (104), a fabric connector (600), and a rib center joint (500), wherein the features and interoperation operation of these components are presented below.

As shown in FIGS. 1-3, and 6 the umbrella assembly (100) includes a pole (101) having a first end (101*a*), a second end (101*b*), a pole bore (101*c*) extending at least partially along a longitudinal axis (101*e*) of the pole first end (101*a*), a through-hole (101*d*) (see FIGS. 6-7) provided at the pole first end (101*a*) and extending through the pole at an angle substantially perpendicular to the pole longitudinal axis (101*e*), height holes (102) extending at least partially into the pole (101) [preferably extending completely through the pole (101)] and provided at a distance from the pole first end (101*a*) and at an angle substantially perpendicular to the pole longitudinal axis (101*e*). The pole (101) further includes a pole pin (102*a*) for insertion into the selected height holes (102), wherein preferably 5 or more height holes (102) are provided on the pole (101) which allows the pole pin (102*a*) to be inserted into the pole (101) at varying distances from the pole first end (101*a*). The pole pin (102*a*) is removably attached to the pole 101 via a pole pin link (101*f*) such as a string, chain, cord, or similar element.

As shown in FIGS. 4-7, the umbrella assembly (100) further includes a finial stem guide (700) provided atop the pole (101), wherein the finial stem guide includes a proximal end (700*a*), a first section (710) having threads (715), a second section (720) adjacent the first section (710), and a third section (730) adjacent the second section (720). The third section (730) includes a stem guide distal end (700*b*), a periphery (731), and complimentary threaded through-holes (735) extending through the third section periphery (731). The finial stem guide (700) further includes a bore (740) extending at least partially into the stem guide (700), the bore (740) extending from the distal end (700*b*) towards the stem guide proximal end (700*a*).

Figure 6:
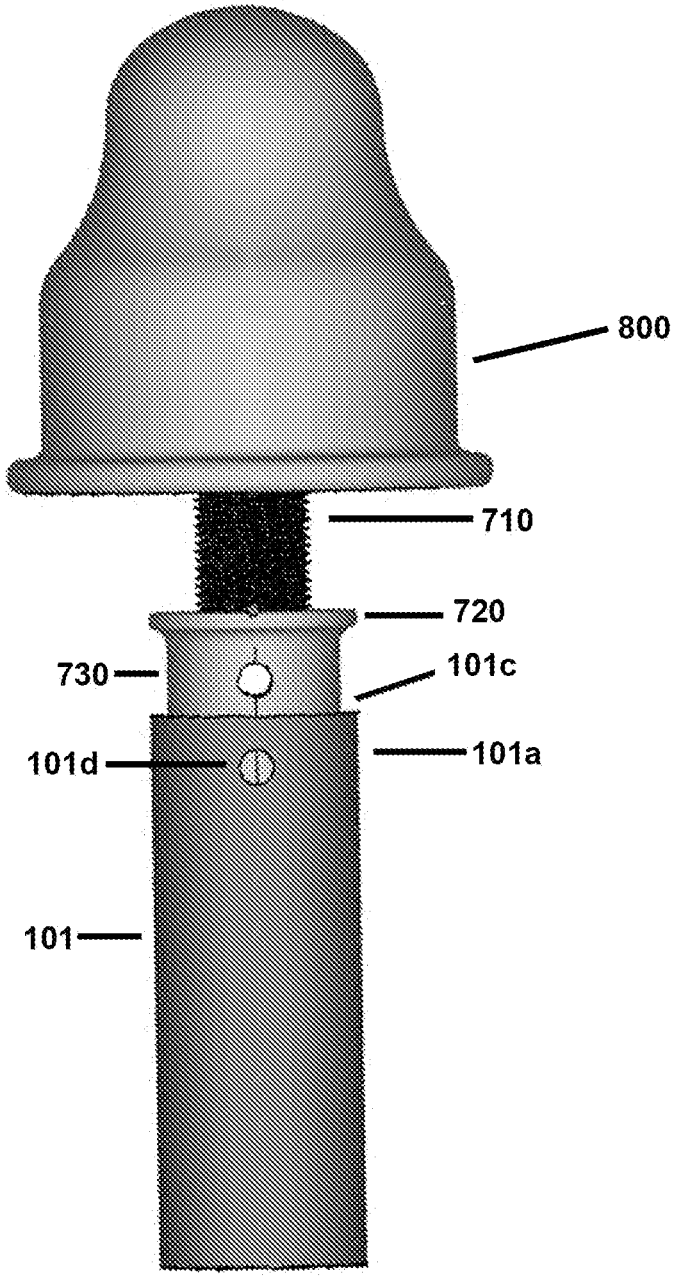
FIG. 6 shows the finial stem guide inserted into the finial cap and the pole.
Figure 7:
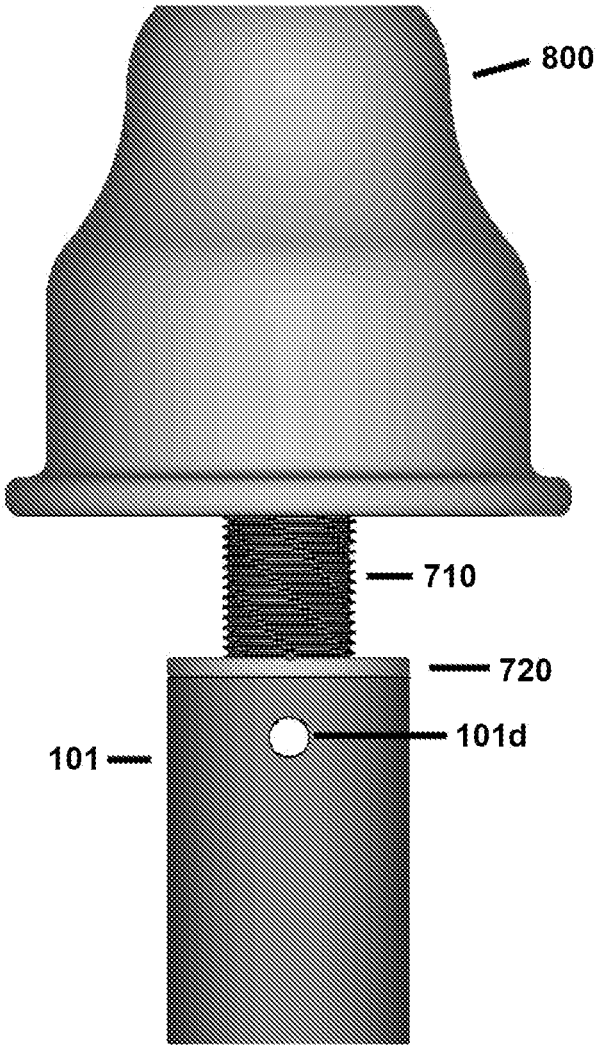
FIG. 7 shows the finial stem guide inserted into the finial cap and fully seated onto the pole.

As shown in FIG. 6 the diameter of the stem guide third section (730) is smaller than the diameter of the pole bore (101*c*) and the diameter of the stem guide third section (730) is also smaller than the diameter of the stem guide second section (720), while the diameter of the stem guide second section (720) is equal to or greater than the diameter of the pole bore (101*c*). This allows the stem guide second section (720) to abut the pole first end (101) at the pole bore (101*c*) when the stem guide (700) is inserted into the pole bore (101*c*) (see FIG. 7) and therefore limit the depth the finial stem guide (700) seats into the pole first end (101*a*). Once the finial stem guide (700) is inserted into the pole bore (101*c*), the stem guide through-holes (735) are aligned with the pole through-hole (101*d*).

Figure 8:
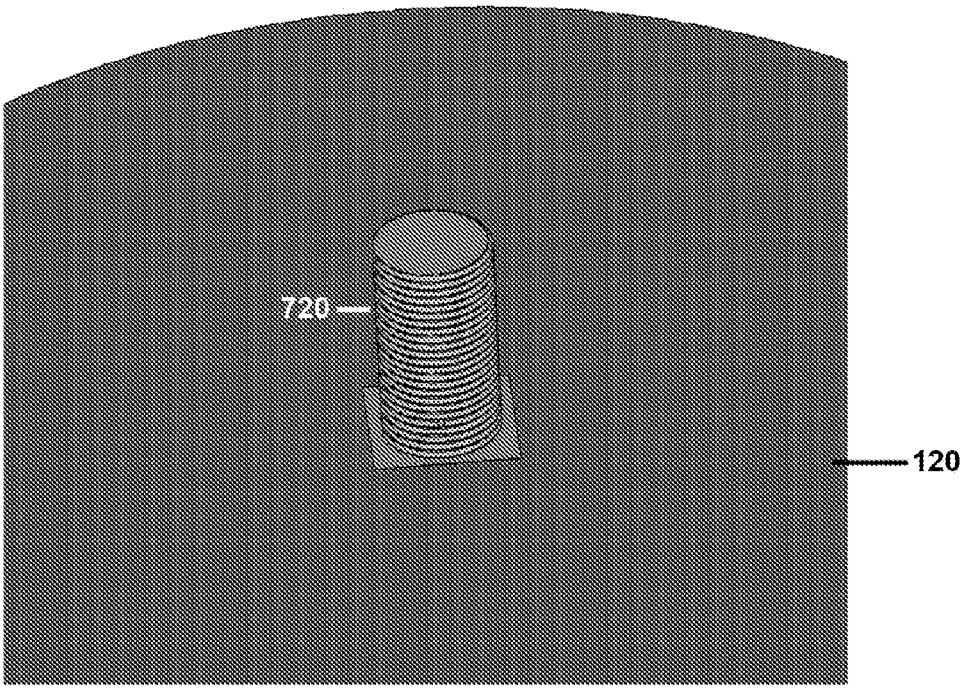
FIG. 8 shows the finial stem guide inserted into the fabric.

As shown in FIG. 8, the umbrella assembly (100) further includes a fabric (120) positioned over the stem guide second section (720), wherein the fabric (120) extends across the umbrella assembly (100) as further described herein.

Figure 9:
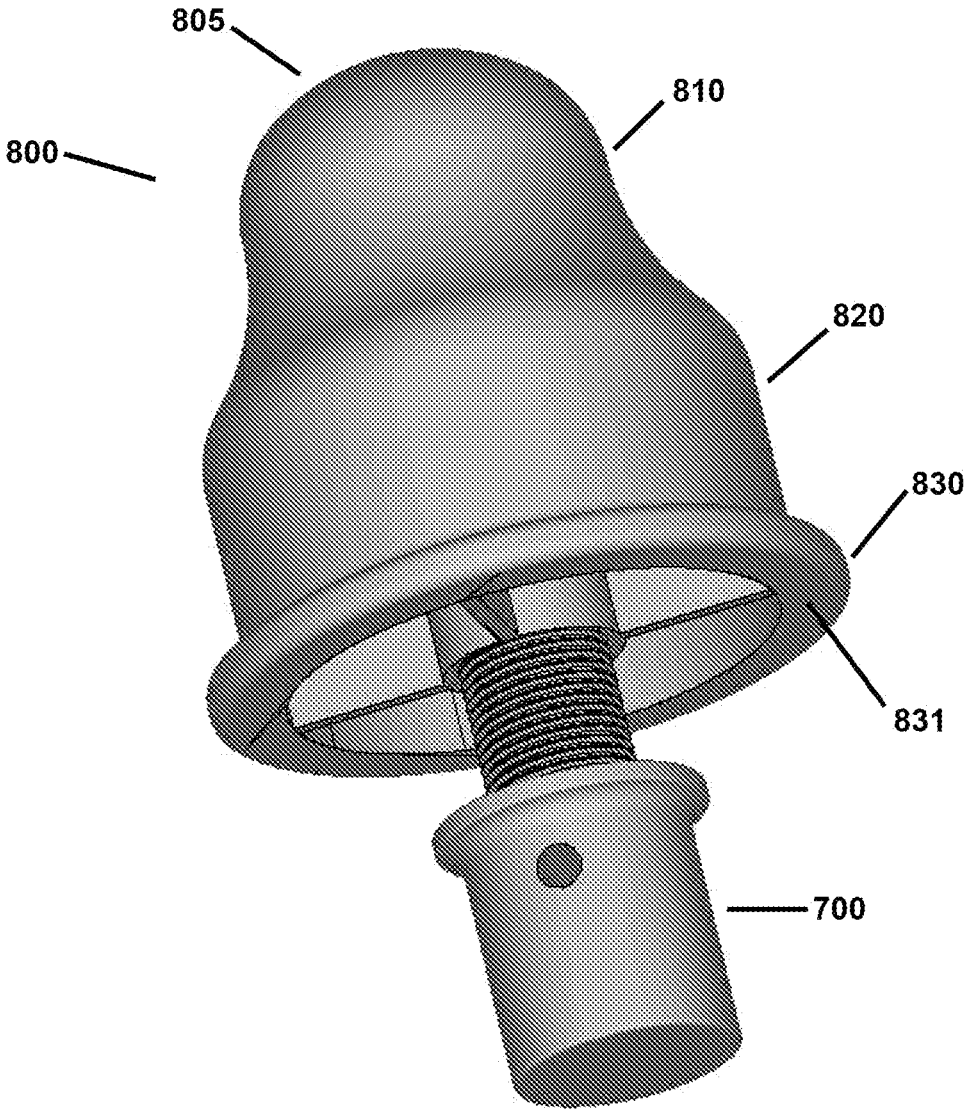
FIG. 9 shows the finial stem guide inserted into the finial cap.
Figure 10:
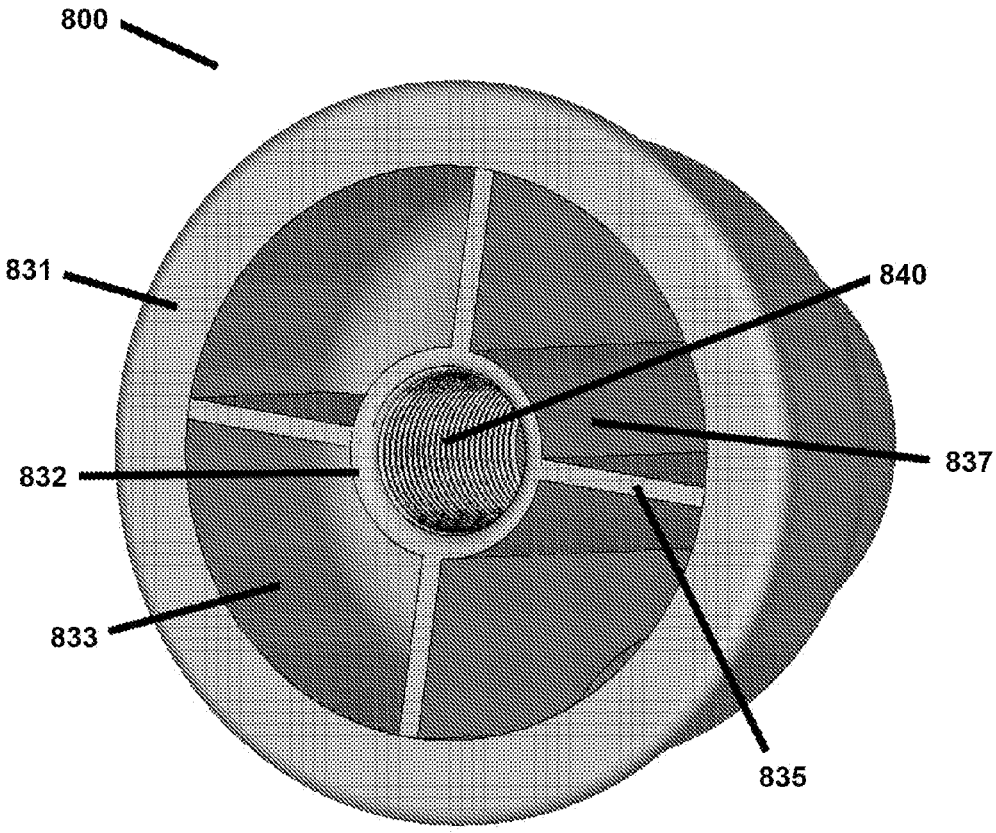
FIG. 10 displays the interior of the finial cap.

As shown in FIGS. 9-10, the umbrella assembly (100) further includes a finial cap (800) which is removably fastened atop the finial stem guide (700). The finial cap (800) includes a cap tip (805), a first region (810) adjacent to the tip (805), a second region (820) adjacent to the first region (810), a third region (830) adjacent to the second region (820) wherein the third region includes surface (831) at the distal end opposite the cap tip (805).

The finial cap (800) further includes a bore (832) extending into the cap interior from the surface (831) towards the cap tip (805), the bore (832) forming interior walls (833) within the cap interior, wherein internal ribs (835) extend from the interior walls (833) and support an internal extension (837) having internal extension threads (840) extending longitudinally within the internal extension (837) in a direction aligned with the finial cap bore (832).

The finial cap (800) is removably fastened atop the fabric (120) and the finial stem guide (700) by screwing the threaded finial stem guide first section (710) into the finial cap (800) threaded internal extension (837) and securely sandwiching the fabric (120) between the finial stem guide (700) and the finial cap (800). The width of the surface (831) is selected to provide a large foot print for the finial cap (800) and thereby by secure an optimal amount of fabric (120) between the finial stem guide (700) and the finial cap (800).

Figure 3:
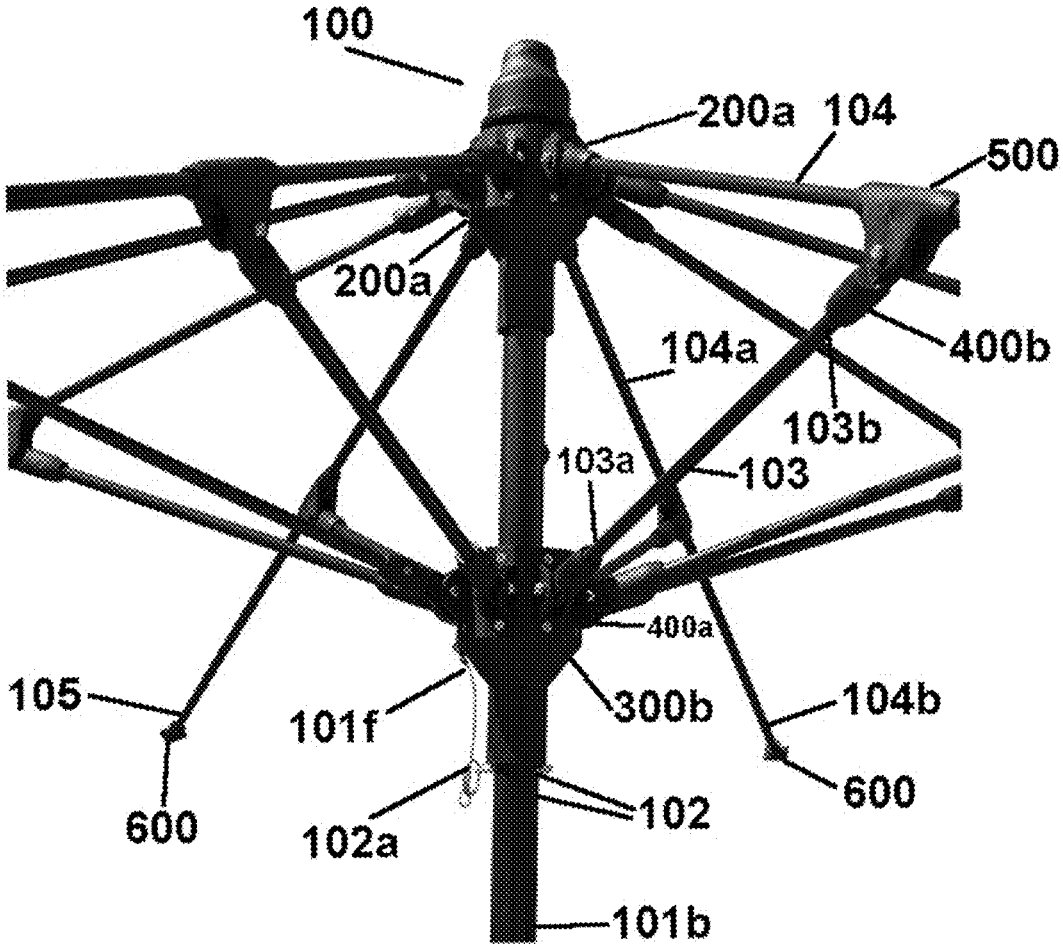
FIG. 3 the general components of the umbrella support apparatus in an open position.
Figure 4:
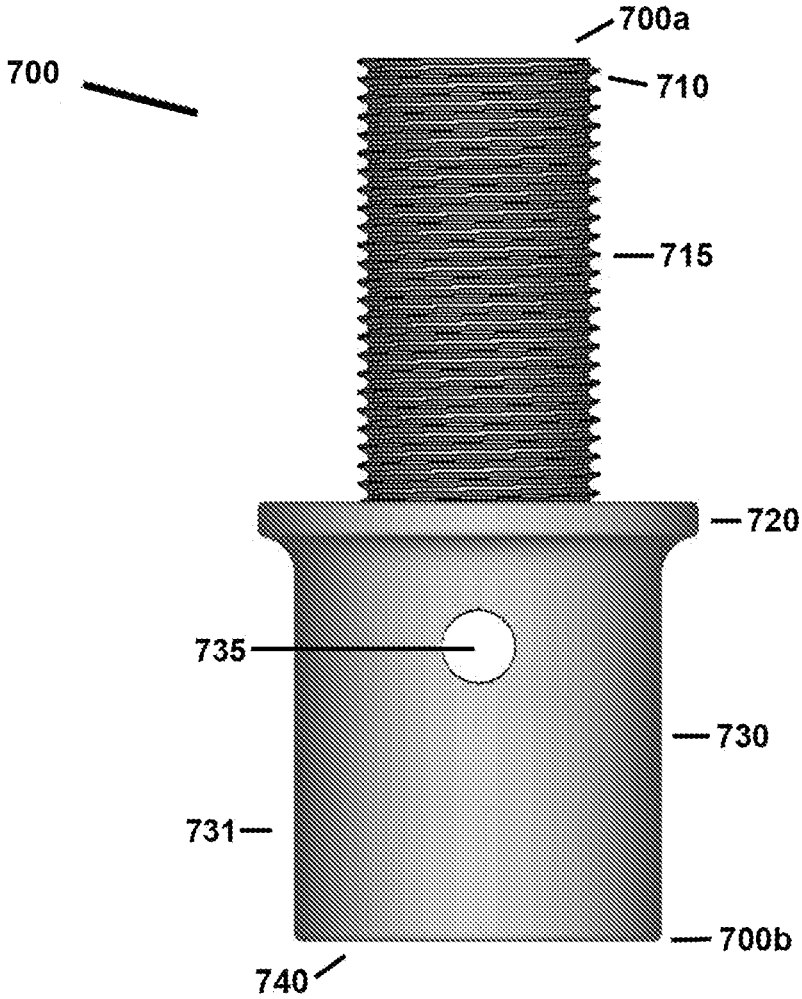
FIG. 4 shows the finial stem guide.
Figure 5:
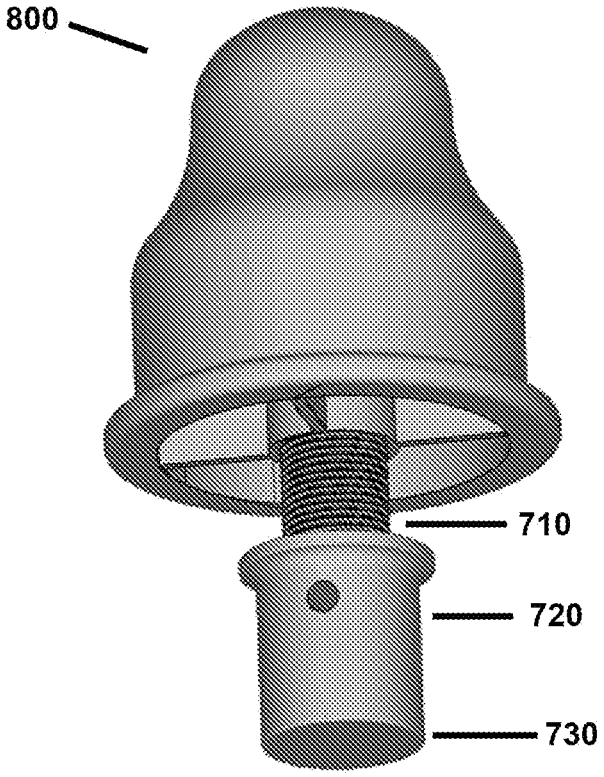
FIG. 5 shows the finial stem guide inserted into the finial cap.
Figure 11:
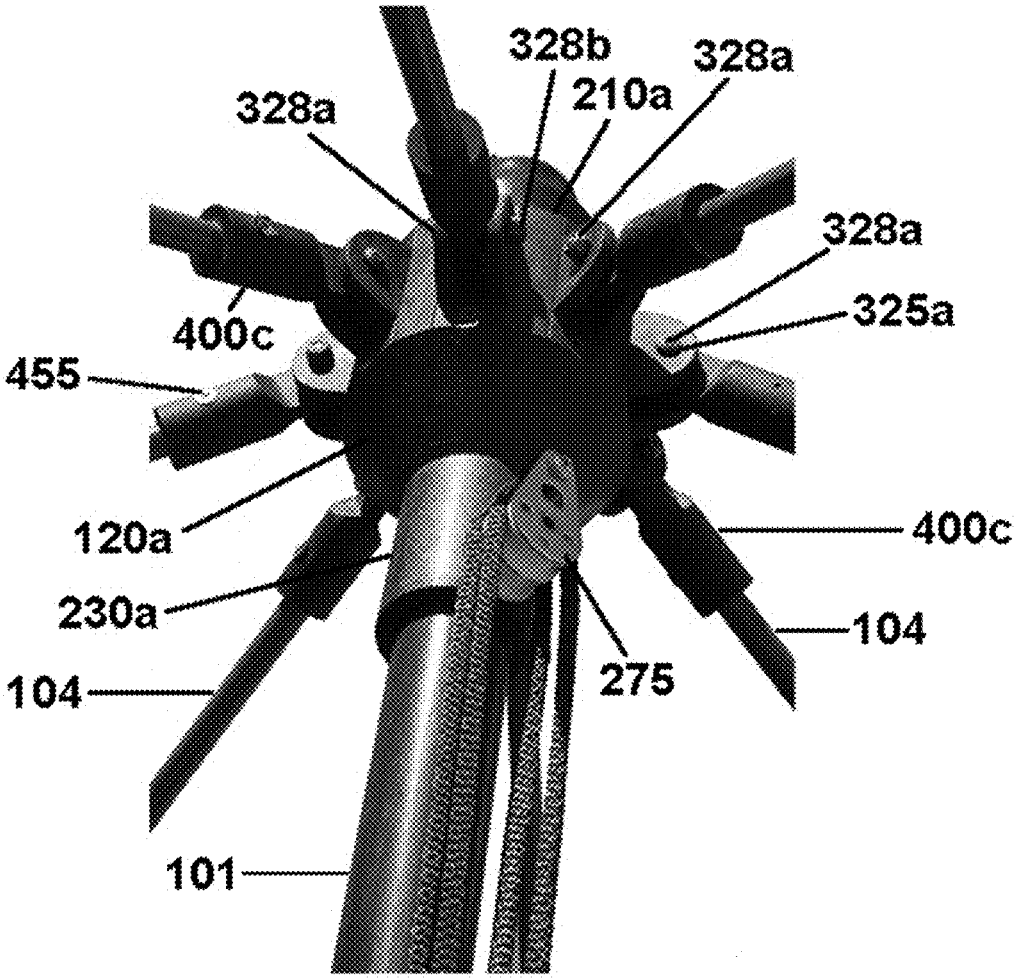
FIG. 11 shows a bottom view of the first hub assembly mounted to the pole.
Figure 12:
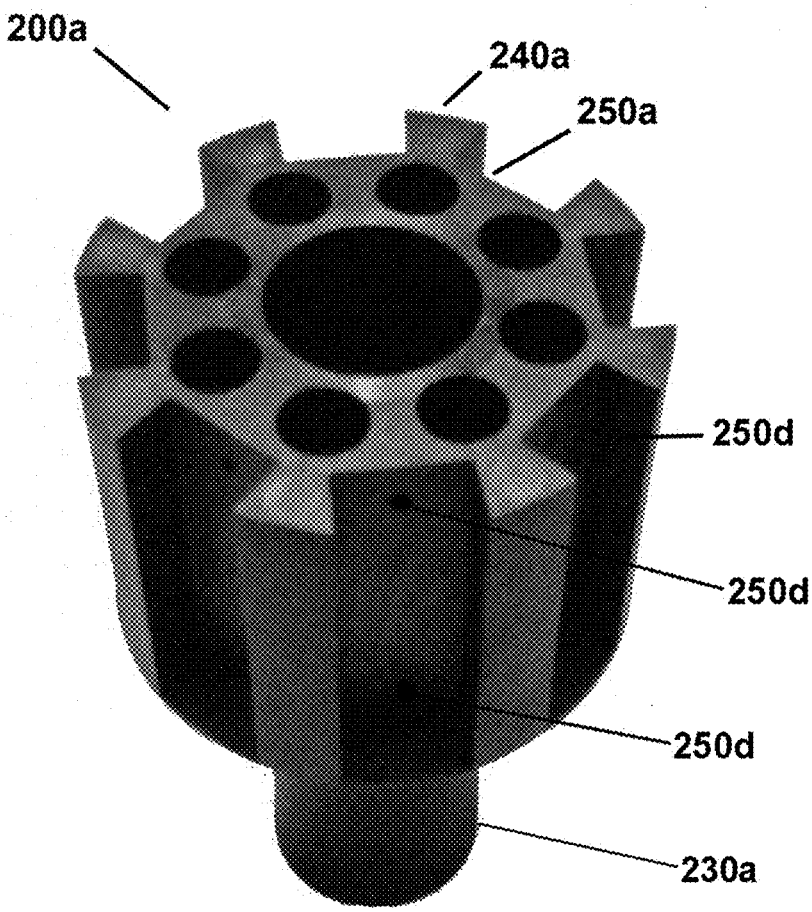
FIG. 12 displays a hub assembly.
Figure 13:
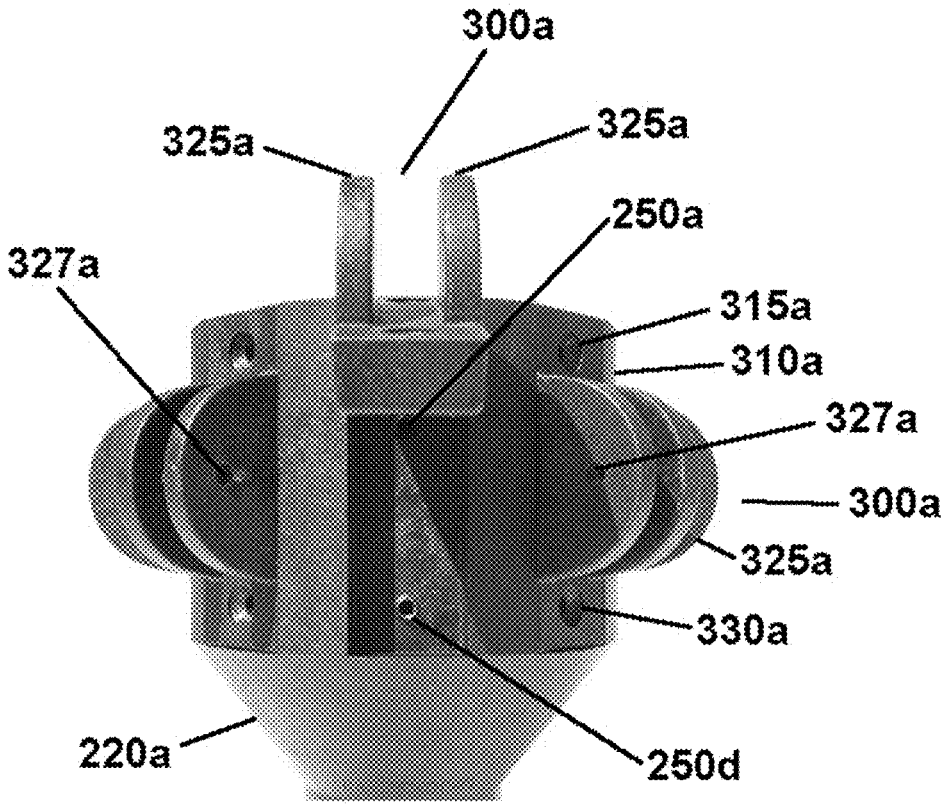
FIG. 13 shows a hub assembly with one of the mounted brackets slightly lifted up.
Figure 14:
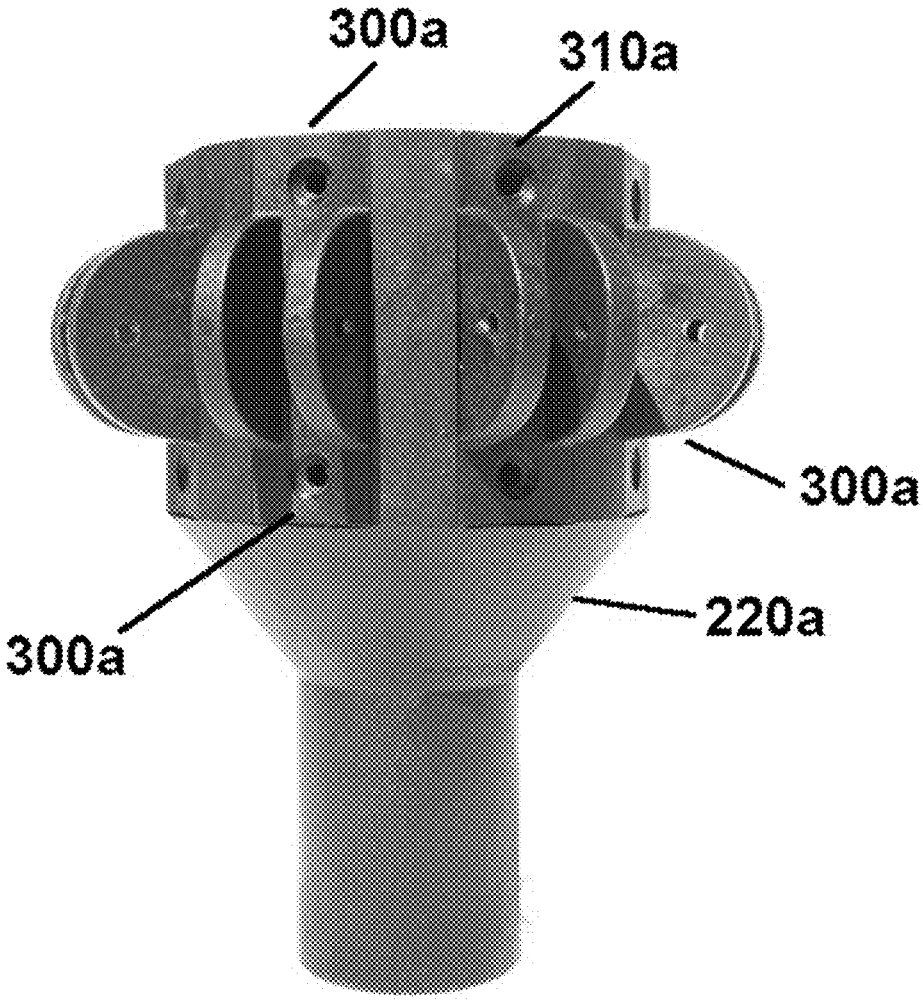
FIG. 14 shows a hub assembly with flushly attached mounted brackets.
Figure 15:
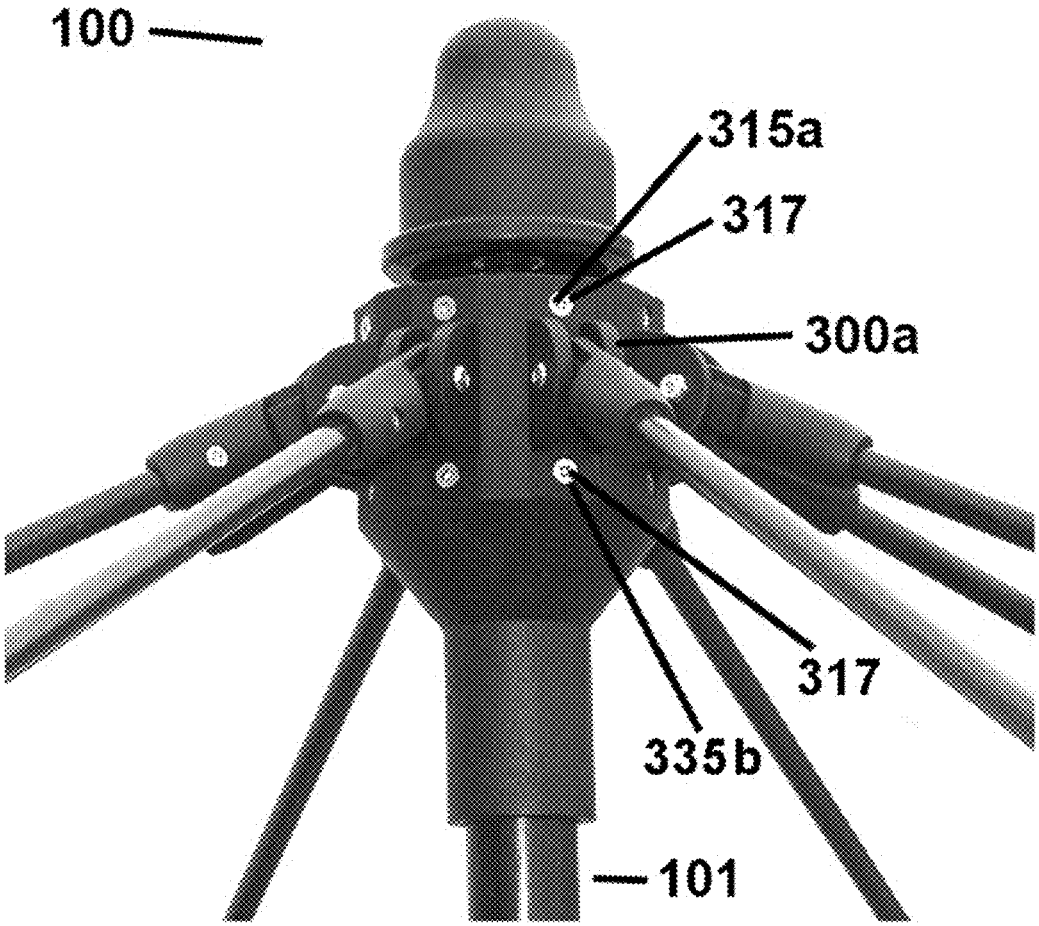
FIG. 15 shows a side view of the first hub assembly mounted to the pole.
Figure 16:
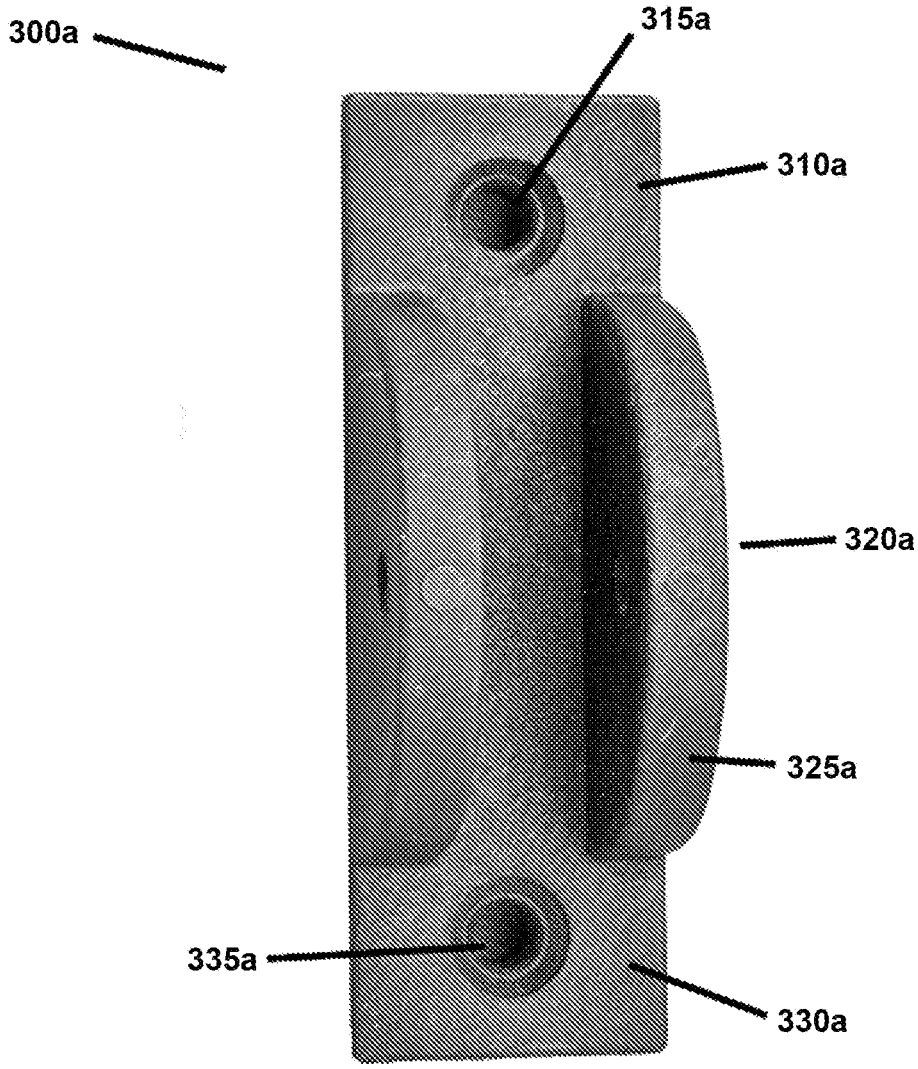
FIG. 16 shows a mounting bracket.
Figure 17:
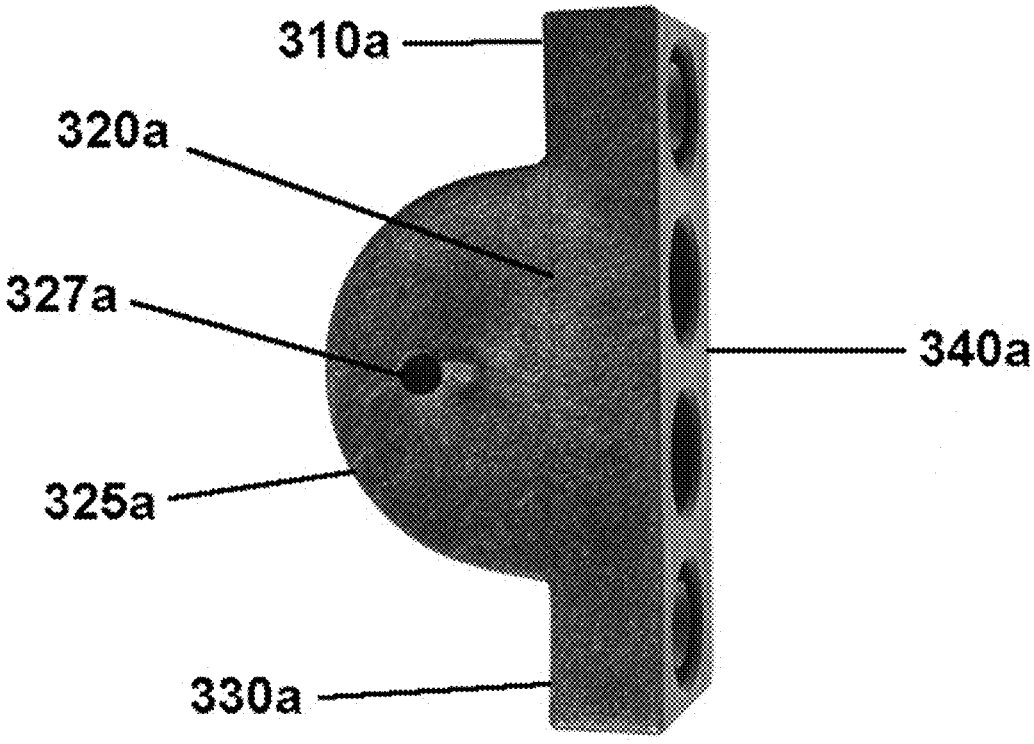
FIG. 17 shows a bottom oriented side view of a mounting bracket.

As shown in FIGS. 3 and 11-12, the umbrella assembly (100) further includes a first hub assembly (200*a*) fixably mounted onto the pole (101), the first hub assembly (200*a*) being positioned below the finial stem guide (700). The first hub assembly (200*a*) includes a mounting section (210*a*), a tapered section (220*a*) connected to the mounting section (210*a*), a handle section (230*a*) connected to the tapered section (220*a*), a plurality of extensions (240*a*) positioned on the mounting section (210*a*), and a plurality of channels (250*a*) positioned on the mounting section (210*a*). The handle section (230*a*) preferably extends along the pole (101) at a length which allows for easier gripping of the hub assembly and which also adds rigidity.

As shown in FIGS. 11, 13 and 15-17, the umbrella assembly (100) further includes at least one first mounting bracket (300*a*) flushly seated in each first hub assembly channel (250*a*). Each first mounting bracket (300*a*) includes a first region (310*a*) having a first region screw hole (315*a*), a second region (320*a*) adjacent to the first region (310*a*), the second region (320*a*) including mounting bracket arms (325*a*) extending outwardly from the second region (320*a*)

and having mounting bracket arm holes (327*a*). Preferably the edges of the mounting bracket arms (325*a*) are curved. As shown in FIG. 11, bolt (328*a*) and nut (328*b*) secures mounting bracket arms (325*a*) to the respective eyelet connector.

The first mounting bracket (300*a*) further includes a third region (330*a*) adjacent to the second region (320*a*), the third region (330*a*) having a third region screw hole (335*a*). The first region (310*a*) and the third region (330*a*) of each first mounting bracket (300*a*) is flushly attached to the hub assembly.

The combined first, second, and third regions (310*a*, 320*a*, 330*a*) form an underside mounting region (340*a*) having a shape complementary to the respective first hub assembly channel (250*a*), wherein the first region (310*a*) and the third region (330*a*) extend beyond the second region (320*a*) at a length sufficient to include the first and third region screw holes (315*a*, 335*a*), preferably at a length at least 50% of the width of the mounting bracket (300*a*). The first region (310*a*) and the third region (330*a*) are flush mounted with the circumference of the mounting section (210*a*), thereby providing added surface area for attaching additional components (such as a ring or other supplemental components).

As shown in FIG. 3, the umbrella assembly (100) further includes mounting bracket screws (317) inserted into the mounting bracket screw holes (315*a*, 335*a*). Additionally, screwed into a first region and/or third region mounting bracket screw hole (315*a*, 335*a*) and extend through at least one first hub assembly channel hole (250*d*), through at least one pole through-hole (101*d*) at the pole first end (101*a*) and into at least one finial stem guide threaded through-hole (735). This secures the first mounting bracket (300*a*) to the first hub assembly (200*a*) and secures the mounting bracket/hub assembly combination to the pole first end (101*a*) and to the finial stem guide (700). The mounting bracket screws (317) fixably mount the first hub assembly (200*a*) onto the pole (101) at the pole first end (101*a*).

The first mounting bracket (300*a*) has an underside mounting region (340*a*) that provides a surface contact area with the first hub assembly channel (250*a*) which greatly enhances the strength and rigidity of the hub assembly (100) by distributing forces applied to the first mounting bracket (300*a*) across a large area beneath the first mounting bracket (300*a*). Additionally, the length of the mounting bracket first region (310*a*) and third region (330*a*) provides extended areas for distributing forces and further adds to the strength and rigidity of the hub assembly (100). The additional force distribution areas of the first mounting bracket (300*a*) makes the hub assembly (100) of the instant invention ideal for use in high gusty wind environments and adds to the durability of the umbrella assembly.

As shown in FIGS. 18-21, the umbrella assembly (100) further includes a second hub assembly (200*b*) movably mounted onto the pole (101) below the first hub assembly (200*a*), the second hub assembly (200*b*) including a mounting section (210*b*), a tapered section (220*b*) attached to the mounting section (210*b*), a handle section (230*b*) attached to the tapered section (220*b*), a plurality of extensions (240*b*) positioned on the mounting section (210*b*), and a plurality of channels (250*b*) positioned on the mounting section (210*b*). The handle section (230*b*) preferably extends along the pole (101) at a length which allows for easier gripping of the hub assembly and which also adds rigidity.

Figure 19:
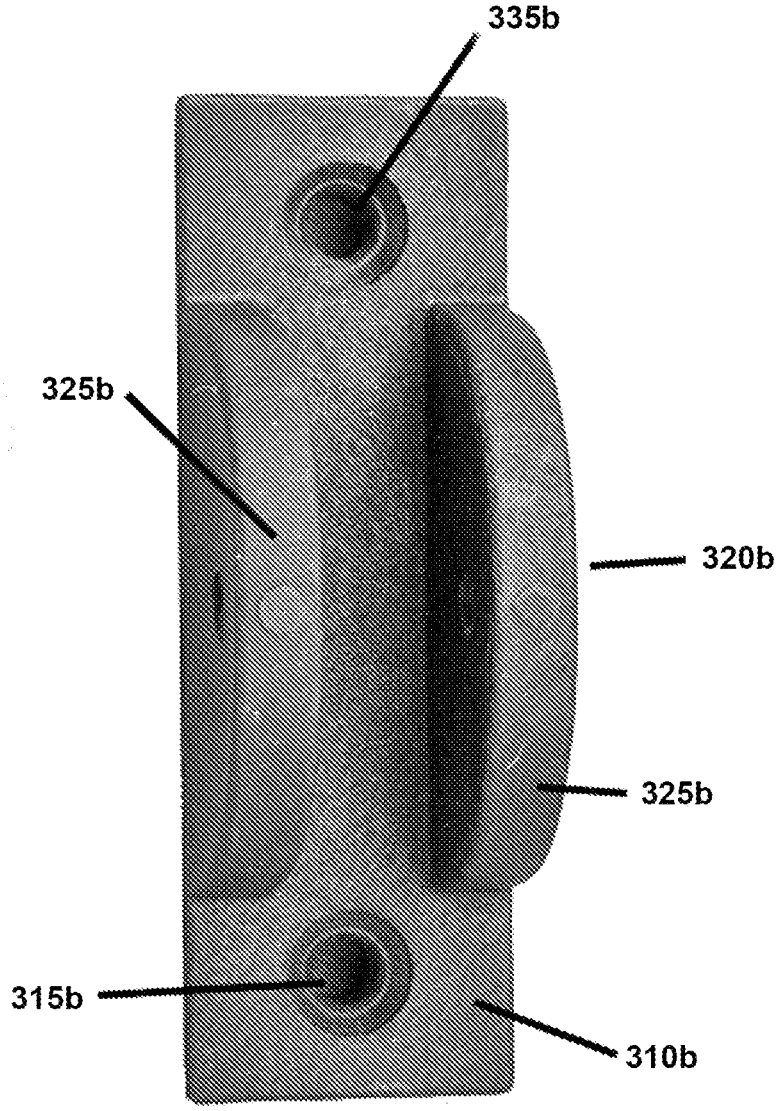
FIG. 19 shows a mounting bracket.
Figure 20:
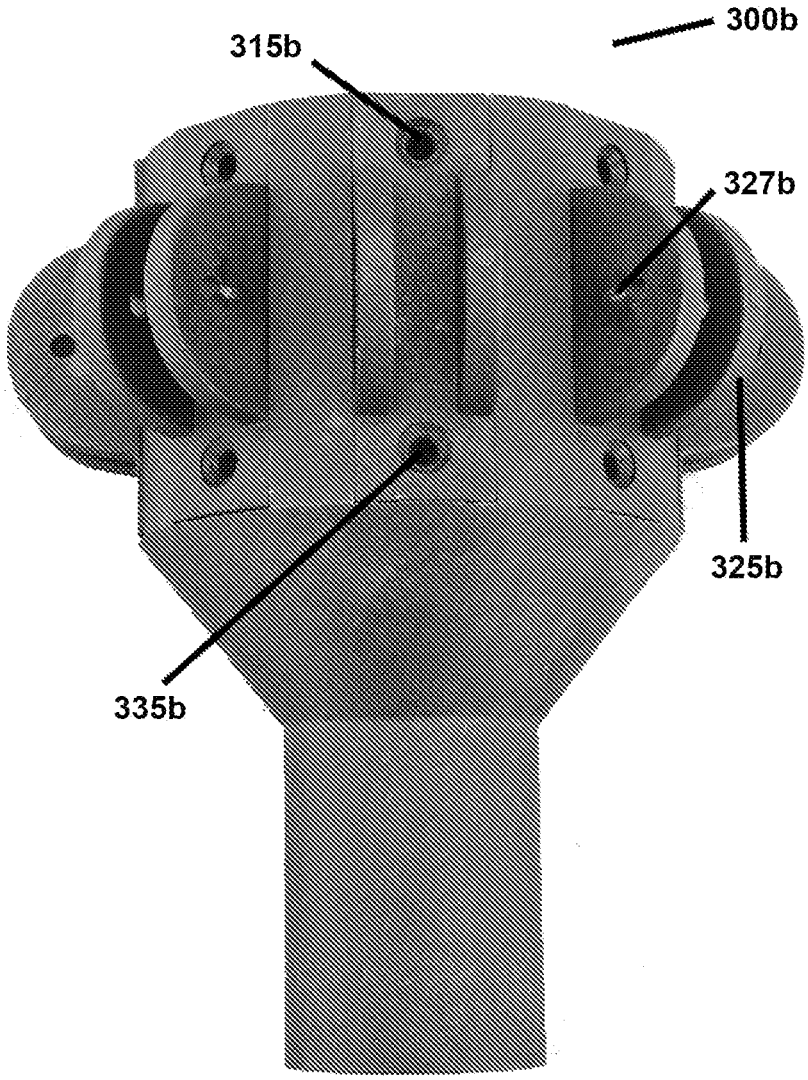
FIG. 20 a hub assembly with flushly attached mounted brackets.
Figure 21:
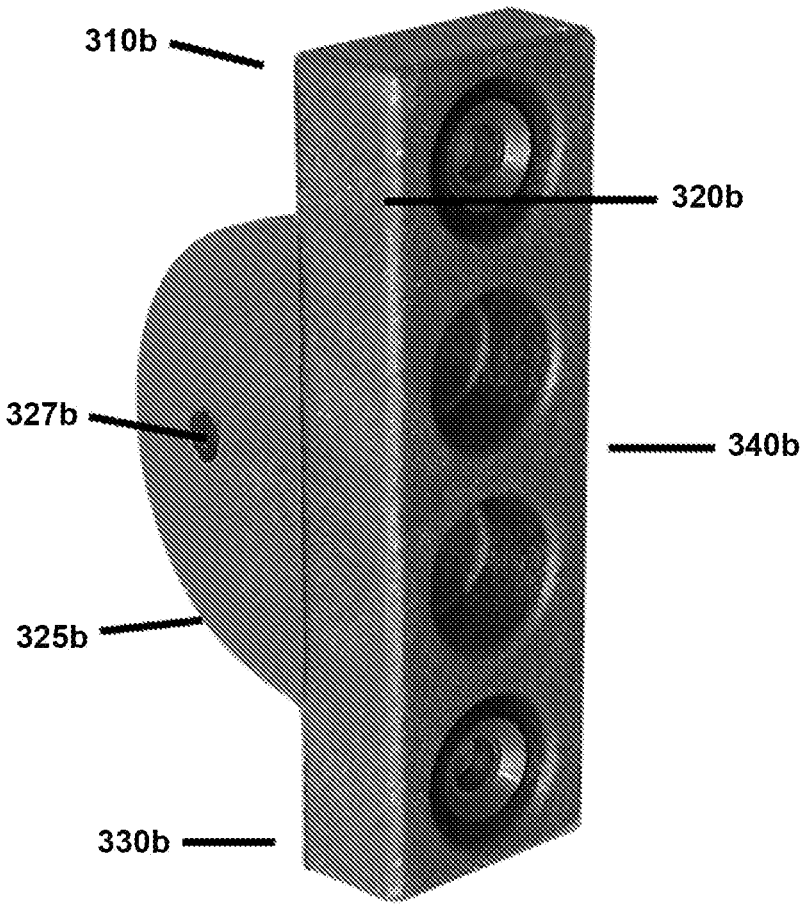
FIG. 21 shows a bottom oriented side view of a mounting bracket.

As shown in FIG. 19-21, the umbrella assembly (100) includes at least one second mounting bracket (300*b*) flushly seated in each second hub assembly channel (250*b*), each second mounting bracket (300*b*) including a first region (310*b*) having a first region screw hole (315*b*), a second region (320*b*) adjacent to the first region (310*b*), the second region (320*b*) including mounting bracket arms (325*b*) extending outwardly from the second region (320*b*) and having mounting bracket arm holes (327*b*), wherein preferably the edges of the mounting bracket arms (325*b*) are curved. Bolt (328*a*) and nut (328*b*) secures mounting bracket arms (325*b*) to the respective eyelet connector. The second mounting bracket (300*b*) further including a third region (330*b*) adjacent to the second region (320*b*), the third region (330*b*) having a third region screw hole (335*b*). The first region (310*b*) and the third region (330*b*) of each second mounting bracket (300*b*) is flushly attached to the hub assembly.

The combined first, second, and third regions (310*b*, 320*b*, 330*b*) form an underside mounting region (340*b*) having a shape complementary to the respective second hub assembly channel (250*b*), wherein the first region (310*b*) and the third region (330*b*) extend beyond the second region (320*b*) at a length sufficient to include the first and third region screw holes (315*b*, 335*b*), preferably at a length at least 50% of the width of the mounting bracket (300*b*). The first region (310*b*) and the third region (330*b*) are flush mounted with the circumference of the mounting section (210*b*) thereby providing added surface area for attaching additional components (such as a ring or other supplemental components).

The second mounting bracket (300*b*) underside mounting region (340*b*) provides a surface contact area with the second hub assembly channel (250*b*) which greatly enhances the strength and rigidity of the hub assembly (100) by distributing forces applied to the mounting bracket (300*b*) across a large area beneath the mounting bracket (300*b*). Additionally, the length of the mounting bracket first region (310*b*) and third region (330*b*) provides extended areas for distributing forces and further adds to the strength and rigidity of the hub assembly (100). The additional force distribution areas of the second mounting bracket (300*b*) makes the hub assembly (100) of the instant invention ideal for use in high gusty wind environments and adds to the durability of the umbrella assembly.

As shown in FIG. 3, the umbrella assembly (100) includes mounting bracket screws (317) inserted into mounting bracket screw holes (315*b*, 335*b*).

As shown in FIG. 11, the umbrella assembly (100) may include a pulley system (275) attached to the first hub assembly (200*a*) and the second hub assembly (200*b*) (not shown). The pulley system (275) assists users in operating the umbrella assembly (100) by aiding in the lowering and raising of the second hub assembly (200*b*).

Figure 18:
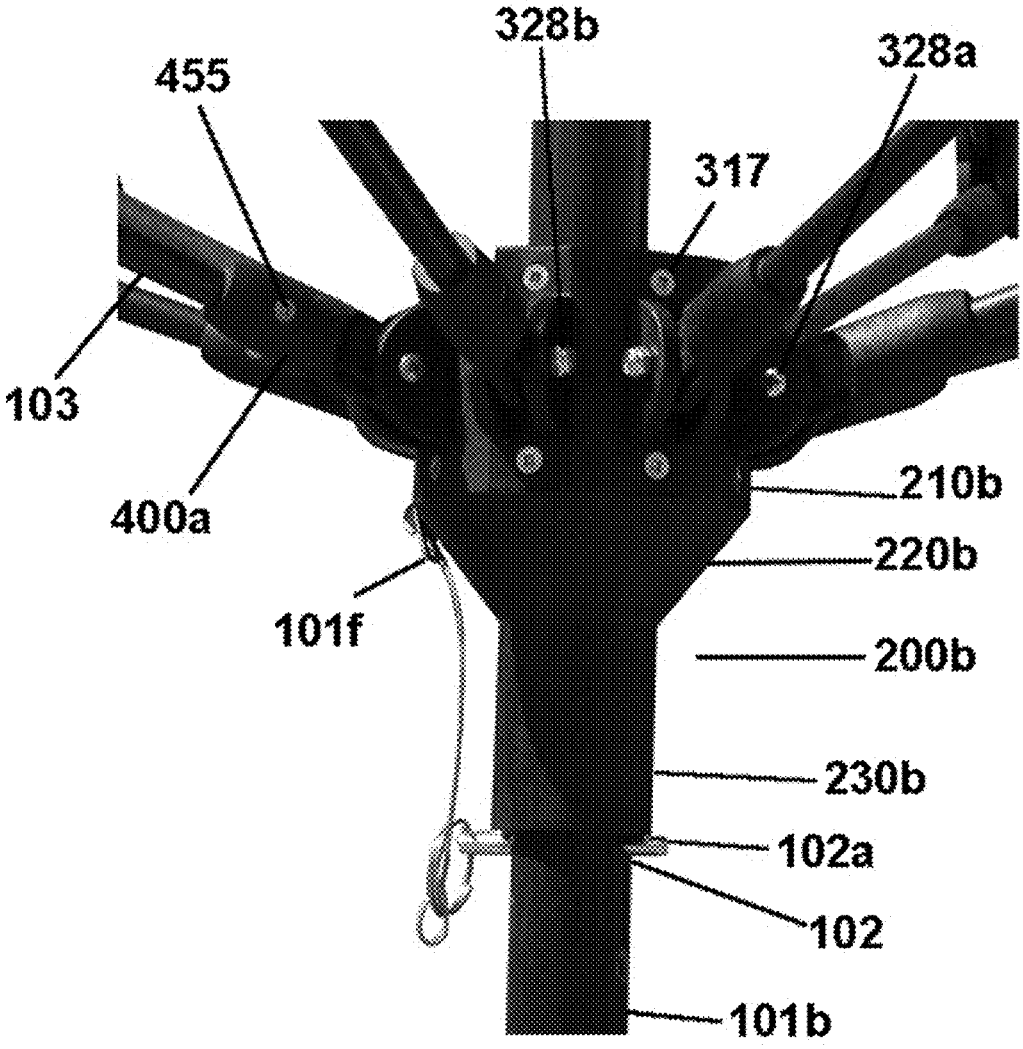
FIG. 18 shows a side view of the second hub assembly mounted to the pole.

As shown in FIGS. 1, 3 and 18, the umbrella assembly (100) includes lower ribs (103) which include a first eyelet connector (400*a*) provided at a first end (103*a*) of each lower rib (103), and a second eyelet connector (400*b*) provided at a second end (103*b*) of each lower rib (103). Each lower rib first eyelet connector (400*a*) is pivotally connected to a second mounting bracket (300*b*).

As shown in FIGS. 1, 3, and 11, the umbrella assembly (100) further includes upper ribs includes an aperture (104*c*—not shown) positioned approximately at the midsection of the length of each of the upper ribs (104), a first eyelet connector (400*c*) provided on a first end (104*a*) of each upper rib (104), and a fabric connector (600) rotatably provided on a second end (104*b*) of each upper rib (104) at a rotation junction (105). Each upper rib first eyelet connector (400*c*) is pivotally connected to a first mounting bracket (300*a*) at the first hub assembly (200).

Figure 22:
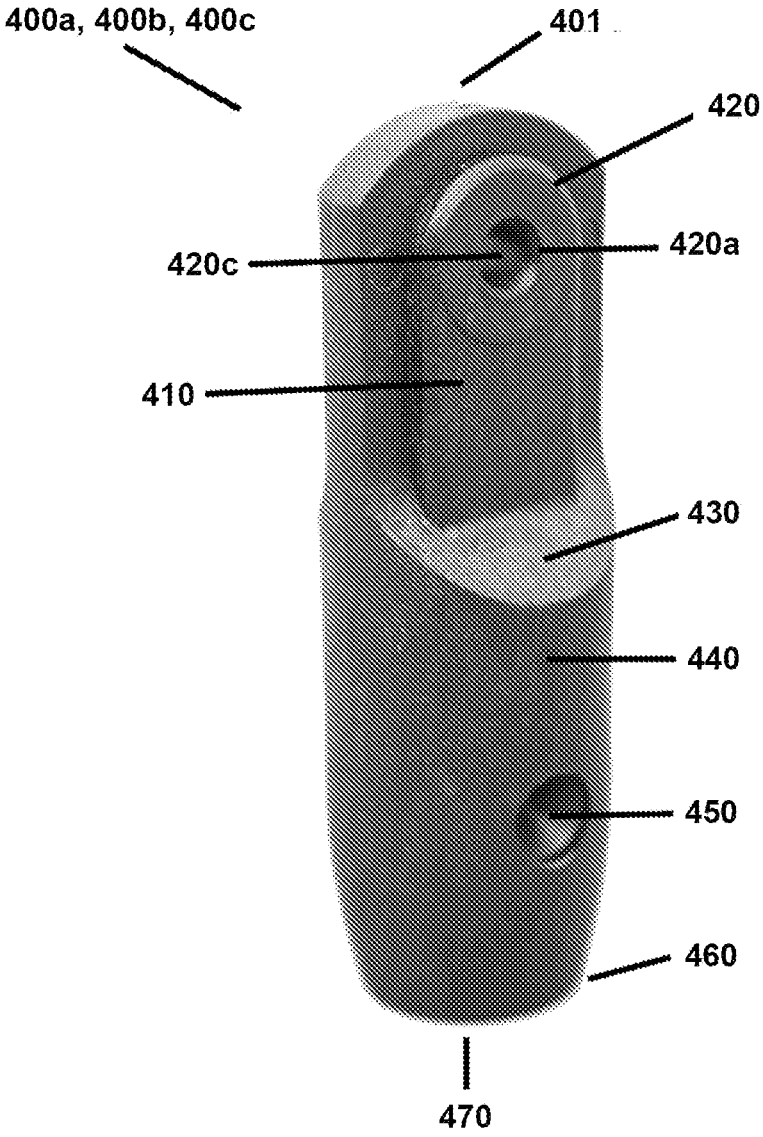
FIG. 22 shows an eyelet connector.

As shown in FIG. 22, each eyelet connector (400*a*, 400*b*, 400*c*) includes a radially curved first end (401), an extension arm (410) adjacent the radially curved first end (401), a pair of raised bushings (420) having an aperture (420*a*) and mounted to the periphery of the extension arm (410). Each eyelet connector (400*a*, 400*b*, 400*c*) further includes an extension arm through-hole (420*c*) extending through the extension arm (410) and interconnecting the raised bushing apertures (420*a*), a first tapered section (430) adjacent the extension arm (410), a main body (440) adjacent the first tapered section (430), a recessed mounting hole (450) extending into the main body (440), a second tapered lower section (460) adjacent the main body (440), and a center bore (470) extending at least partially into the tapered lower section (460) at an angle substantially perpendicular to the recessed mounting hole (450). Screw (455) secures each eyelet connector (400*a*, 400*b*, 400*c*) to the respective rib. See FIG. 18.

The first tapered section (430) of the eyelet connectors allow the smooth rotation of the respective lower rib and upper rib first eyelet connectors (400*a*, 400*c*) when attached to first and second mounting bracket arms (325*a*, 325*b*) by providing a clearance between the edges of the applicable first and second mounting bracket arms (325*a*, 325*b*). See FIGS. 11 and 18.

Figure 23:
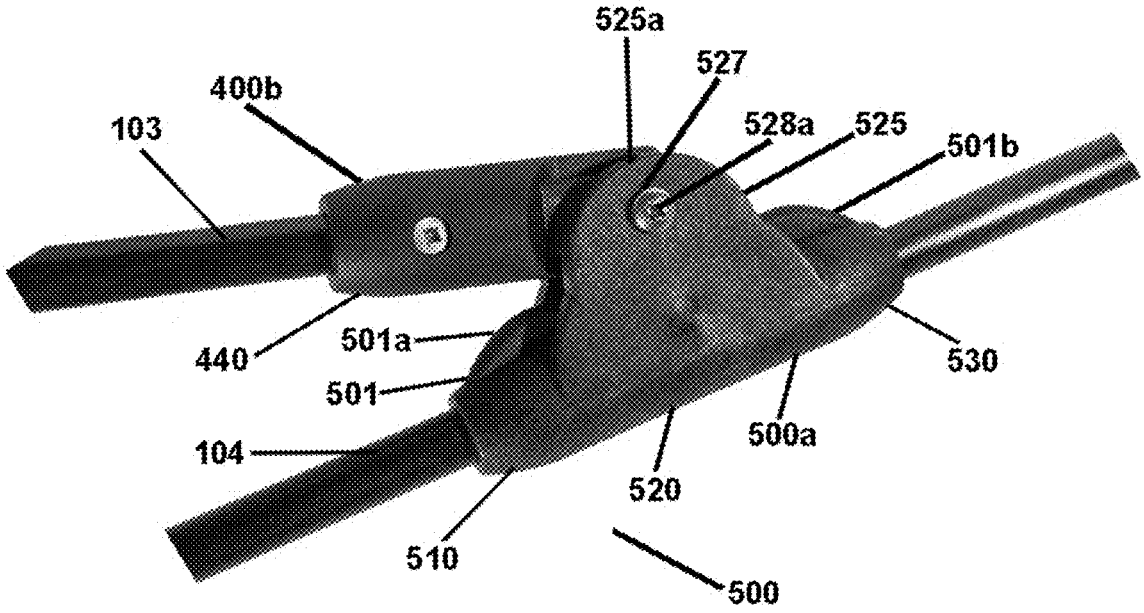
FIG. 23 shows a side view of rib center joint.
Figure 24:
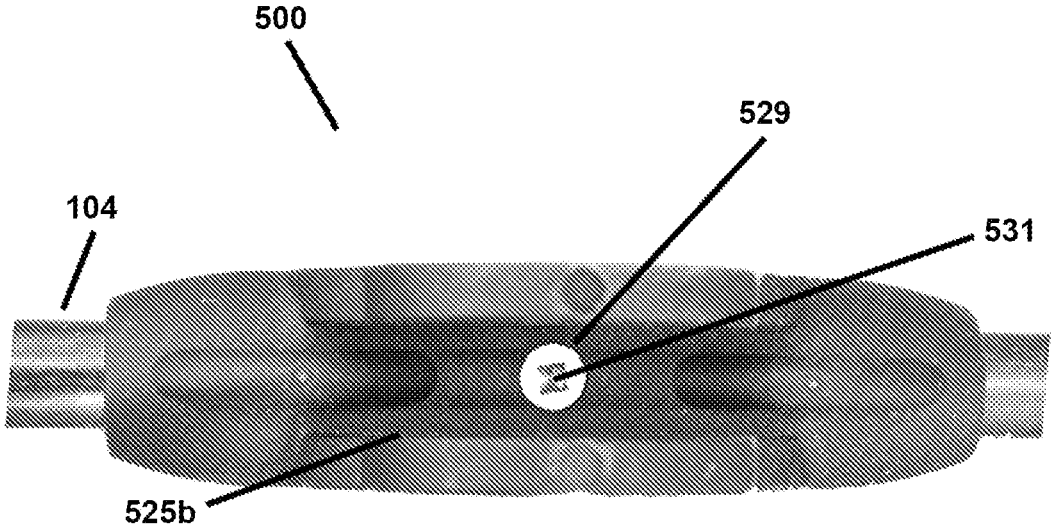
FIG. 24 shows a top view of a rib center joint.

As shown in FIGS. 23-24, the umbrella assembly (100) further includes an elongated rib center joint (500) provided substantially at the midsection of each upper rib (104). Each rib center joint (500) includes a first region (510), a second region (520) adjacent the first region (510), and a third region (530) adjacent the second region (520).

The second region includes a plurality of rib center joint arm extensions (525) each having a curved peripheral edge (525*a*), and a hole (527) extending perpendicular to the curved peripheral edge (525*a*) and positioned at a distance from the rib center joint second region (520). The junction between the rib center joint arm extensions (525) and the rib center joint second region (520) includes a fillet (525*b*) which enhances the strength of the junction by distributing forces applied to the junction by the rib center joint arm extensions (525). This force distribution fillet (525*b*) greatly enhances the durability of the rib center joint (500). Bolt (528*a*) and nut (528*b*) secures each eyelet connector (400*b*) to the respective center rib joint (500).

The combined first, second, and third regions (510, 520, 530) form a rib center joint body (500*a*) having a rib center joint through-hole (505) extending sequentially through the combined first, second, and third regions (510, 520, 530) of the rib center joint body (500*a*).

An upper rib (104) extends through the rib center joint through-hole (505) and a lower rib (103) is pivotally connected to the rib center joint arm extensions (525) at the rib center joint holes (527) by an eyelet connector bolt (528*a*) which extends simultaneously through the rib center joint holes (527), the eyelet connector raised bushing apertures (420*a*), and the eyelet connector extension arm through-hole (420*c*). The present invention uses a length of the rib center joint body (500*a*) which provides enhanced rigidity and aids in distributing bending forces applied to the junction of the rib center joint body (500*a*) and the rib (104) extending through the rib center joint body (500*a*). Locknut (528*b*) is screwed onto eyelet connector bolt (528*a*) to secure the connection.

Each rib center joint (500) further includes a pair of raised rib center joint stops (501) with a first rib center joint stop (501*a*) extending across the first region (510) and the second region (520), and a second rib center joint stop (501*b*) extending across the second region (520) and the third region (530). The rib center joint stops (501) are positioned on the periphery of the rib center joint body (500*a*) between the rib center joint arm extensions (525) such that during operation of the umbrella assembly (100) from an open position to a closed position or vice versa (see FIGS. 1-2) the rib center joint stops (501) limit the travel of the lower rib (103) by abutting the main body (440) of the eyelet connector (400*b*) before the lower rib (103) can make contact with the upper rib (104). A rib center joint aperture (529) is provided on the periphery of the second region (520) and positioned between the stops (501). Preferably the aperture (529) is a counter-sunk hole. Screw (531) secures each rib center joint (500) to the respective rib.

The stops (501) are provided at selected heights wherein the selected height determines the distance between the lower rib (103) and the upper rib (104) in the closed position of the umbrella assembly (100). Significantly, the height of the stops (501) establish the amount of pre-opening bias on the ribs of the umbrella assembly (100) which determines the amount of effort needed to open the umbrella assembly from a closed/stored position to an open position. When a traditional umbrella is closed, an umbrella opening force is applied to the ribs to move them from a closed position to an open position. The initial force required to open an umbrella in which the upper and lower ribs are in close contact (or nearly close contact) is most often higher than when the upper and low ribs are further apart. There is an initial "break-point" where the umbrella assembly resists opening whereas beyond the "break-point" less force is required to move the ribs of the umbrella assembly. In the operation of opening a traditional umbrella assembly (particularly industrial use umbrella assemblies), a user has to exert a large amount of force to over come the initial "break-point" when the upper and lower ribs are in close contact (or nearly close contact).

The instant invention solves that problem by limiting the closeness of the upper and low ribs via the height of the stops (501). A user of the umbrella assembly (100) of the instant invention can open the umbrella with ease because the stops (501) prevent the upper (104) and lower (103) ribs of the umbrella assembly from coming together below the "break-point" threshold. Also, with variations in overall umbrella assembly designs or in response to umbrella assembly wear and usage issues, different rib center joints (500) can be selected which have stop (501) heights selected for the specific need.

As shown in FIG. 24, the umbrella assembly (100) further includes a locking screw (531) for concurrently inserting into the rib center joint aperture (529) and the upper rib aperture (104*c*—not shown) to secure the rib center joint (500) to the upper rib (104).

Figure 25:
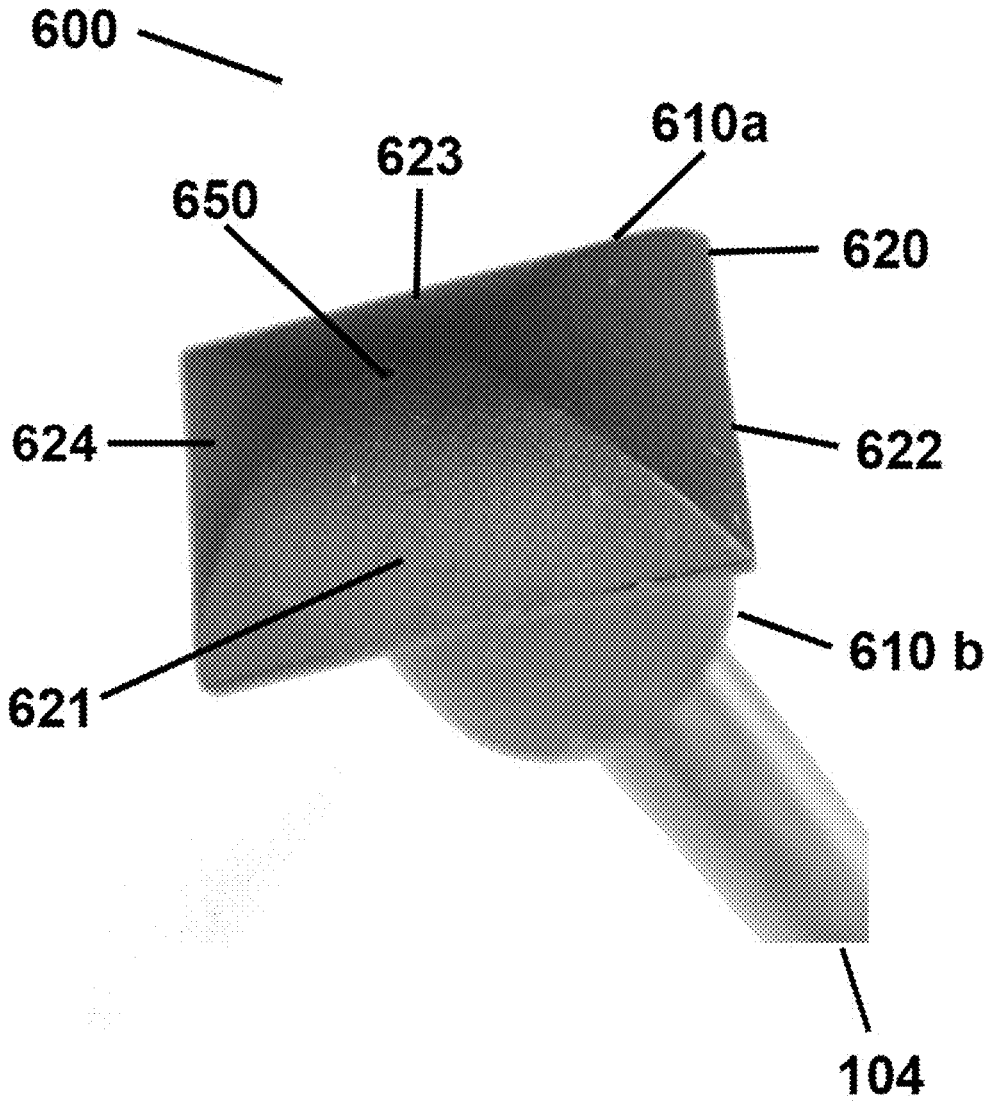
FIG. 25 shows a fabric connector.
Figure 26:
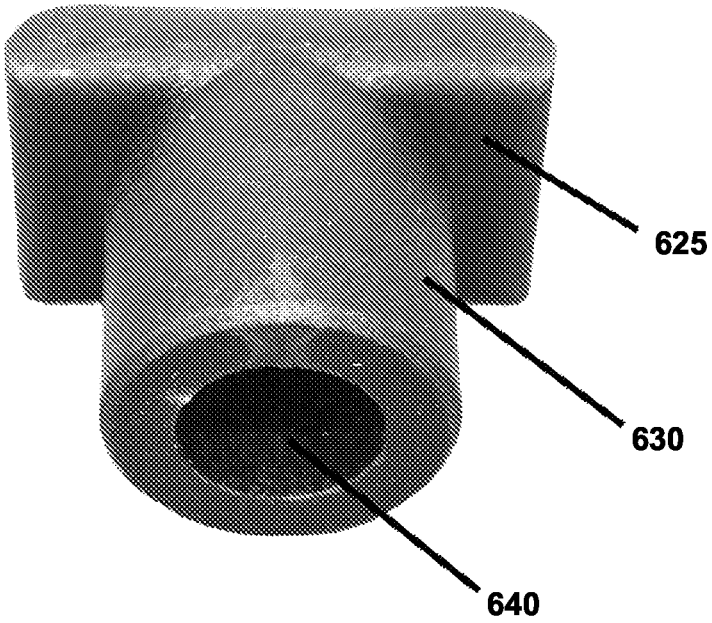
FIG. 26 shows a fabric connector.
Figure 27:
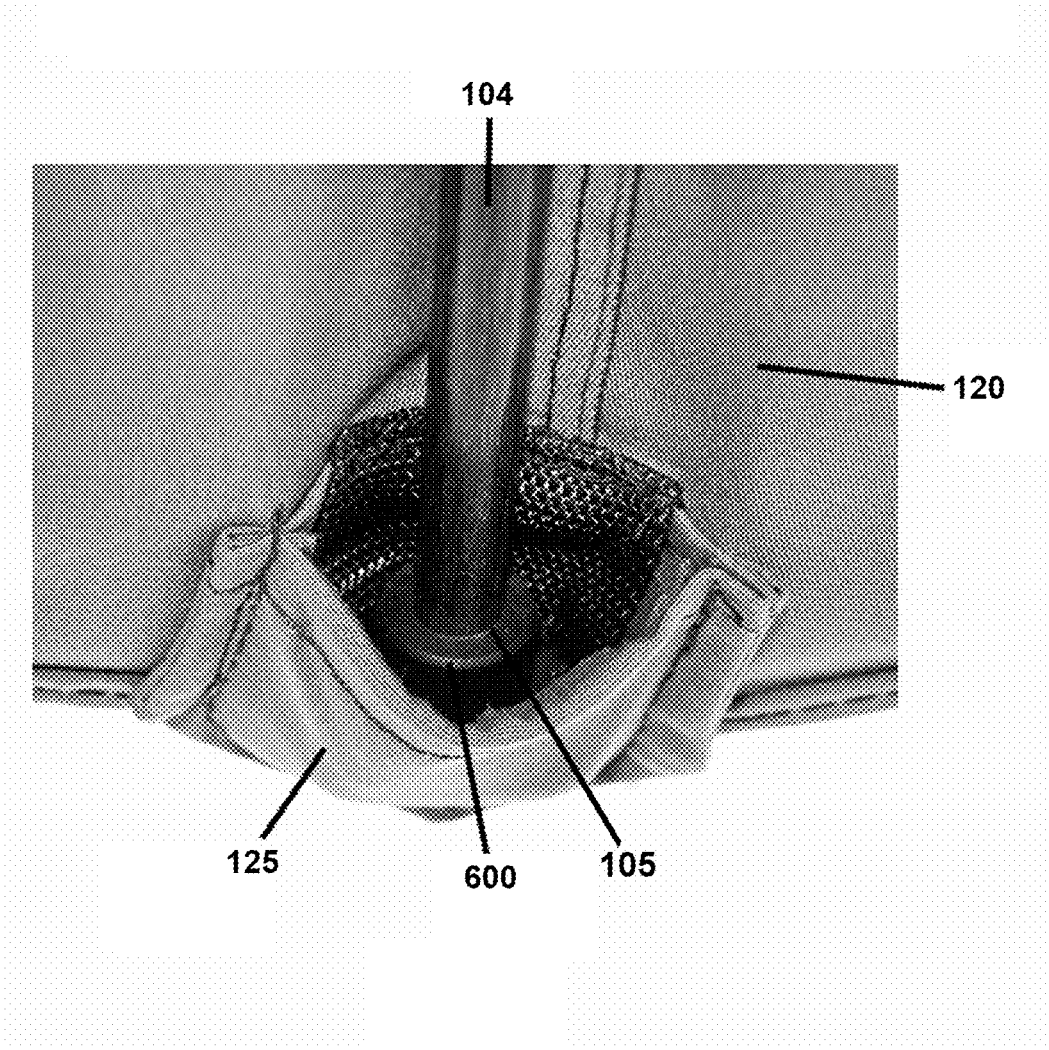
FIG. 27 shows a fabric connector seated in a fabric pocket.

As shown in FIGS. 25-27, each fabric connector (600) includes a first end (610*a*), a second end (610*b*), a head (620), a head first curved surface (621), a head second curved surface (622), a head third curved surface (623), a head fourth curved surface (624), a head bottom surface (625), a main body (630), a center bore (640).

The first, second, third, and fourth curved surfaces (621, 622, 623, 624) of the fabric connector head converge along an intersecting axis (650) positioned at the fabric connector first end (610*a*). The fabric connector center bore (640) extends at least partially into the fabric connector main body (630) from the fabric connector second end (610*b*) towards the fabric connector first end (610*a*). Each fabric connector (600) is rotatably provided on the second end (104*b*) of each upper rib (104) and is engagingly seated into a respective pocket portion (125) of the fabric (120) to hold the fabric (120) tautly across the umbrella assembly (100).

Twists and rotations of the fabric (120) are compensated by rotation of the fabric connector (600) about the rotation junction (105) between fabric connector (600) and the upper rib (104) thereby allowing the fabric connector head (620) to contact the maximum amount of fabric (120) across the fabric connector surfaces (621, 622, 623, 624) and spread the tension forces across the multiple connector surfaces of the fabric connector (600) which reduces the likelihood the fabric connector (600) will penetrate into the fabric (120) and cause fabric tears and rips. The rotation junction (105) is provided by a loose fit between the fabric connector (600) and the upper rib (104). Additionally, a lubricant may be provided at the rotation junction (105) to enhance its effectiveness.

Under high wind forces or active volatile wind conditions, the forces applied to the umbrella assembly (100) are captured by the fabric (120) and distributed across the umbrella assembly (100) and result in the ribs rapidly shifting position and twisting and turning. The forces applied to the upper ribs (104) are transmitted to the rib ends containing the fabric connector (600) which redistributes the forces across the fabric (120). Some ribs receive minimal forces at their rib ends and other ribs receive extremely high forces, for example from a sudden gust of wind. The rotatable fabric connector head (620) of the instant invention shifts positions in accordance with the amount of force applied to the rib end and redistributes the wind force across the fabric connector head surfaces (621, 622, 623, 624) by twisting and turning in response the direction of the applied wind force. The continual dissipation of the wind forces across the fabric connector head surfaces (621, 622, 623, 624) reduces the build-up of tension across the fabric (120) while minimizing the likelihood the rib end will penetrate the fabric (120). The unique self-compensating features of the fabric connector (600) of the instant invention provides a more durable umbrella assembly well suited for high wind environments such as shorelines and beaches.

ALTERNATE EMBODIMENT

The applicable features and elements of the preferred embodiment of the instant invention as well as the other alternate embodiments disclosed herein are understood as being applicable to this embodiment.

Figure 28:
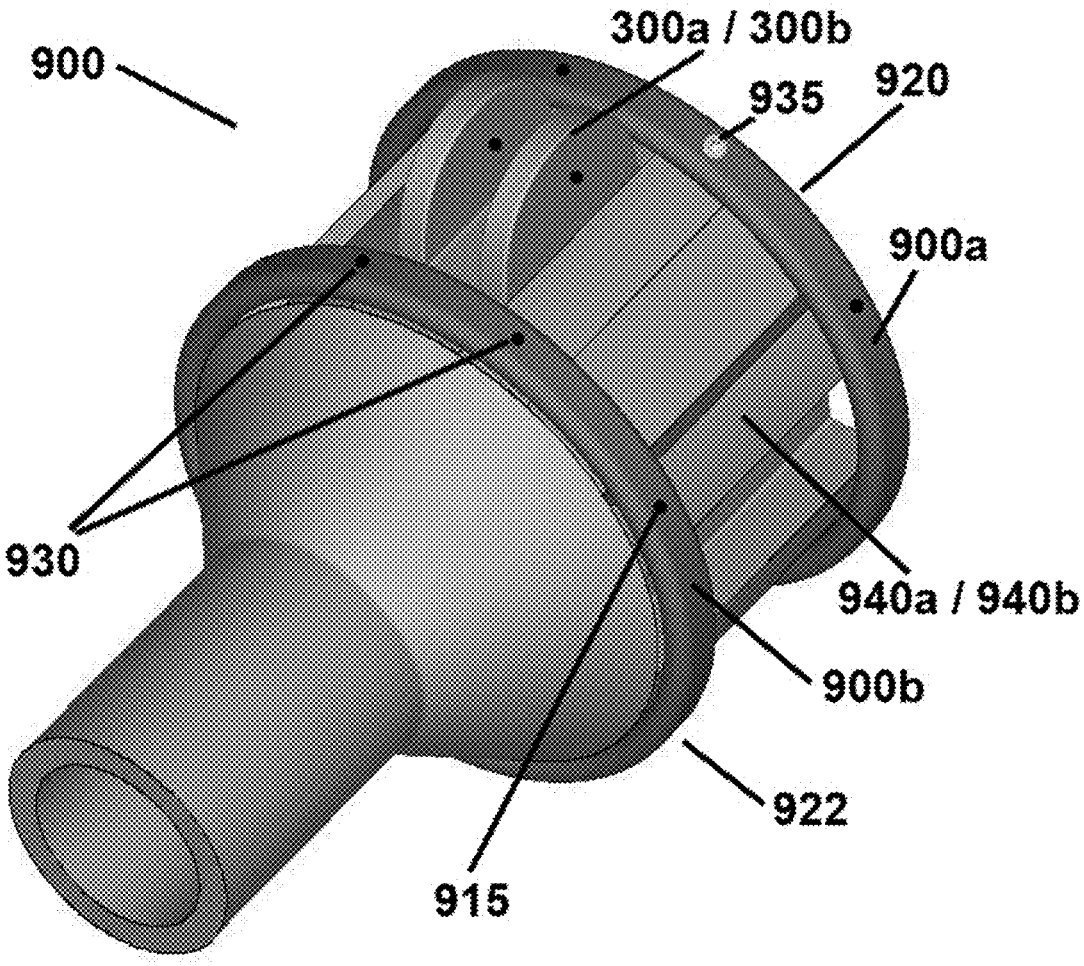
FIG. 28 shows a ringed hub assembly.
Figure 29:
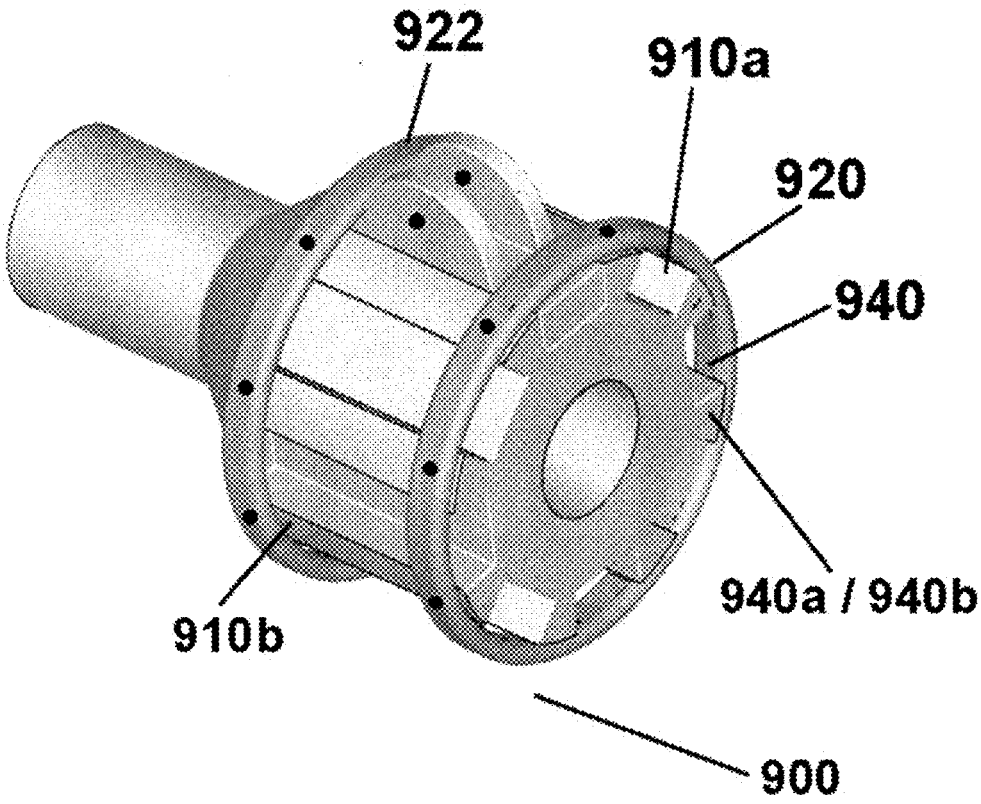
FIG. 29 shows a ringed hub assembly.

As shown in FIGS. 28-29, an alternate ringed hub assembly (900) further includes (in addition to the elements provided on the preferred hub assembly 200*a* or 200*b*) a first securing ring (920) positioned at a first region (900*a*) of the ringed hub assembly (900) mounting section (910*a*,910*b*), and a second securing ring (922) positioned at a second region (900*b*) of the ringed hub assembly (900) mounting section (910*a*, 910*b*).

Each securing ring (920, 922) includes securing ring holes (930) (preferably recessed) positioned around the circumference of each securing ring (920, 922) at positions (915) aligned with the hub assembly extensions (940*a*, 940*b*).

Each securing ring (920, 922) is preferably secured to the ring hub assembly (900) with securing ring screws (935) inserted into the securing ring holes (930) aligned with and extending into the applicable hub assembly extensions (940*a*, 940*b*).

Each securing ring (910, 920) also includes an inner surface (940) which abuts the hub assembly extensions (240*a*, 240*b*).

The securing rings (920, 922) securely lock the first and second mounting brackets (300*a*, 300*b*) to the ringed hub assembly (900). Preferably the width of the outer circumference of securing rings (920, 922) is selected to prevent the eyelet connector (400) from pivoting beyond the periphery of the securing ring (920, 922). More specifically, the width of the outer circumference of the preferred securing rings (920, 922) is selected so that when the umbrella assembly (100) is moved from an open position to a closed position (see FIGS. 1A and 1B) the main body (440) of the applicable eyelet connectors (400*a*, 400*c*) on the respective lower and upper ribs (103, 104) abuts the circumference of securing rings (920, 922) thereby limiting the rotation of the applicable upper rib (104) and lower rib (103). This prevents the ribs from being moved into a fully closed position. Additionally, the securing rings (920, 922) bias the umbrella assembly 100 in an open position making it easier for users to open the umbrella assembly 100.

The width of the circumference of the securing rings (910, 920) can be selected in conjunction with the selection of the appropriate height of the rib center joint stops (501) to selectively establish the pre-open bias of the umbrella assembly (100) and to minimize amount of force a user must apply to open the umbrella assembly (100) with respect to the "breakpoint" (as previously disclosed).

Further, the securing rings (920, 922) can be added to the umbrella assembly (100) of the preferred embodiment of the instant invention to enhance the strength and rigidity of the umbrella assembly (100). The securing rings (920, 922) allow the umbrella assembly (100) to withstand higher wind forces and reduce the potential for mounting bracket failure by securely binding the mounting brackets to the respective hub assembly. Any combination of rings can be used ranging from a single ring to a multitude of rings.

ALTERNATE EMBODIMENT

The applicable features and elements of the preferred embodiment of the instant invention as well as the other alternate embodiments disclosed herein are understood as being applicable to this embodiment.

Figure 30:
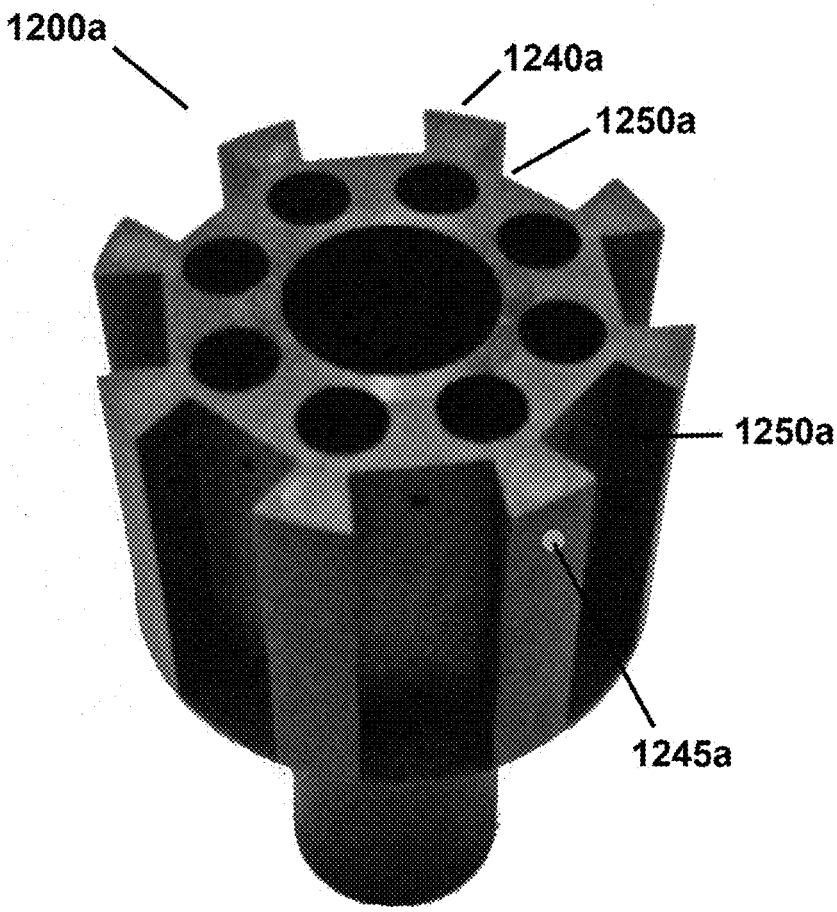
FIG. 30 shows a hub assembly.
Figure 31:
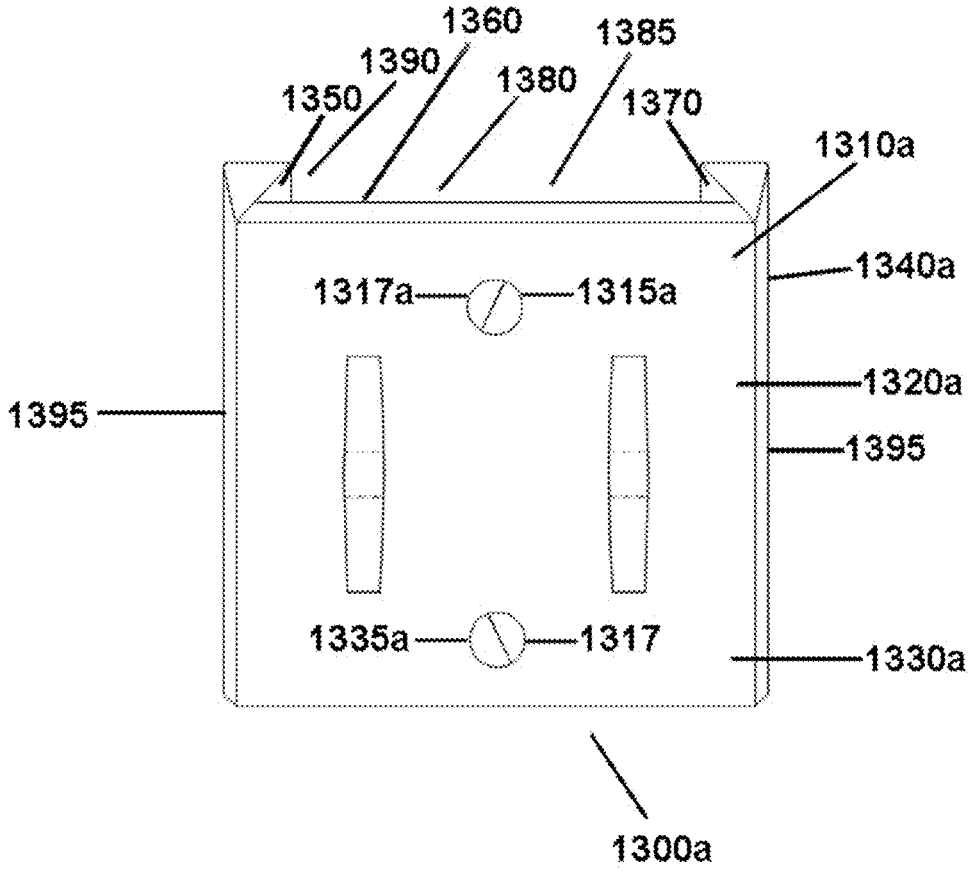
FIG. 31 shows a mortise-tenon mounting bracket.

As shown in FIGS. 30-31, an alternate embodiment of the present invention uses a mortise-tenon umbrella hub assembly (1200*a*) which includes the elements of the preferred hub assembly 200*a* or 200*b* [referred to as the mortise-tenon hub assembly (1200*a* or 1200*b*) in this alternate embodiment]. The first and second mounting brackets (300*a*, 300*b*) of the preferred embodiment are respectively replaced with the mortise-tenon mounting brackets (1300*a*, 1300*b*) and the associated mounting elements and features as disclosed below. The features below presents a mortise-tenon mounting bracket (1300*a*) to be used in the same manner as a first or second mounting bracket (300*a*, 300*b*) of the preferred embodiment, however the mortise-tenon mounting bracket (1300*a*) includes substantial structural differences for mounting the mortise-tenon mounting bracket (1300*a*) to a hub assembly. Mortise-tenon mounting bracket (1300*b*) is not shown and is the same as mortise-tenon mounting bracket (1300*a*).

The mortise-tenon hub assembly (1200*a*) as shown in FIG. 30 has attached a mortise-tenon mounting bracket (1300*a*), as shown in FIG. 31, which can be seated onto each hub extension (1240*a*). The mortise-tenon mounting bracket (1300*a*) serves as a replacement for the first and/or second mounting brackets (300*a*, 300*b*).

Each mortise-tenon mounting bracket (1300*a*) includes a first region (1310*a*) having a first region screw hole (1315*a*), a second region (1320*a*) adjacent to the first region (1310*a*), the second region (1320*a*) including mounting assembly arms (1325*a*) extending outwardly from the second region (1320*a*) and having mounting assembly arm holes (1327*a*), wherein preferably the edges of the mounting assembly arms (1325*a*) are curved. A bolt and nut secures mounting assembly arms (1325*a*) to the respective eyelet connector. The mortise-tenon mounting bracket (1300*a*) further includes a third region (1330*a*) adjacent to the second region (1320*a*), the third region (1330*a*) having a third region screw hole (1335*a*).

The combined first, second, and third regions (1310*a*, 1320*a*, 1330*a*) form an underside mounting region (1340*a*) having a wedged mortise-tenon shape complementary to the respective hub extension (1240*a*). The complimentary mortise-tenon shape is formed by first wall (1350), second wall (1360), and third wall (1370), wherein the walls are provided on the underside of the mortise-tenon mounting bracket (1300*a*) which is opposite the side having the mounting assembly arms (1325*a*). As shown in FIG. 31, the first wall (1350) and the third wall (1370) are provided at an angle which is acute to the second wall (1360) thereby forming a guide (1385) which has a first area (1380) which is larger than a second area (1390).

The guide (1385) shape is complementary and conforming to the shape of the hub extension (1240*a*). The outer sides (1395) of the mortise-tenon mounting bracket (1300*a*) extend perpendicular to the second wall (1360). The width of the mortise-tenon mounting bracket (1300*a*) is such that it extends one half the distance of a mortise-tenon hub assembly (1200*a*) mounting channel (1250*a*) so that when a mortise-tenon mounting bracket (1300*a*) is mounted to a mortise-tenon hub assembly (1200*a*), a portion of the first wall (1350) and the third wall (1370) are seated in adjacent mounting channels (1250*a*) rather than in the same mounting channel.

One or more mortise-tenon mounting brackets (1300*a*) are positioned on the mortise-tenon hub assembly (1200*a*) by aligning each mortise-tenon mounting assembly guide (1385) with a selected hub extension (1240*a*) and sliding the parts together so that the selected hub extension (1240*a*) fills the guide (1385). Since the mortise-tenon mounting bracket (1300*a*) only extends half-way across the mounting channel (1250*a*), two mortise-tenon mounting brackets (1300*a*) can be seated within the same mounting channels (1250*a*) [each occupying half the width of the mounting channel (1250*a*)]. When multiple mortise-tenon mounting brackets (1300*a*) are positioned in the same mounting channel (1250*a*) the edges of the mounting brackets (1300*a*) abut thereby adding additional rigidity to the mortise-tenon hub assembly (1200*a*).

The first region (1310*a*) and the third region (1330*a*) of each mortise-tenon mounting bracket (1300*a*) extend beyond the second region (1320*a*) at a length sufficient to include the first and third region screw holes (1315*a*, 1335*a*), preferably at a length at least 50% of the width of the mounting bracket (1300*a*).

At least one mounting assembly screw (1317) is inserted into each mounting assembly screw hole (1315*a*, 1335*a*). At least one mounting assembly screw (1317*a*) of the mortise-tenon mounting assembly (1300*a*) which is screwed into a first region and/or third region mounting assembly screw hole (1315*a*, 1335*a*) extends through a respective hub extension hole (1245*a*), through at least one pole through-hole (101*d*) at a pole first end (101*a*) and into at least one finial stem guide threaded through hole (735). This secures the mortise-tenon mounting assembly (1300*a*) to the mortise-tenon hub assembly (1200*a*) and secures the mounting assembly/hub assembly combination to the pole first end (101*a*) and to the finial stem guide (700).

For the mortise-tenon mounting bracket (1300*a*) which is used with the first hub assembly (1200*a*), the at least one mounting assembly screw (1317*a*) as disclosed above fixably mounts the mortise-tenon umbrella hub assembly onto the pole (101) at the pole first end (101*a*).

For the mortise-tenon mounting bracket (1300*b*) which is used with the second hub assembly (1200*b*), the mounting assembly screw (1317) does not extend through the pole through-hole (101*d*). This allows mortise-tenon mounting bracket (1300*b*) to be slidably repositioned on the pole (101).

ALTERNATE EMBODIMENT

The applicable features and elements of the preferred embodiment of the instant invention as well as the other alternate embodiments disclosed herein are understood as being applicable to this embodiment.

Figure 32:
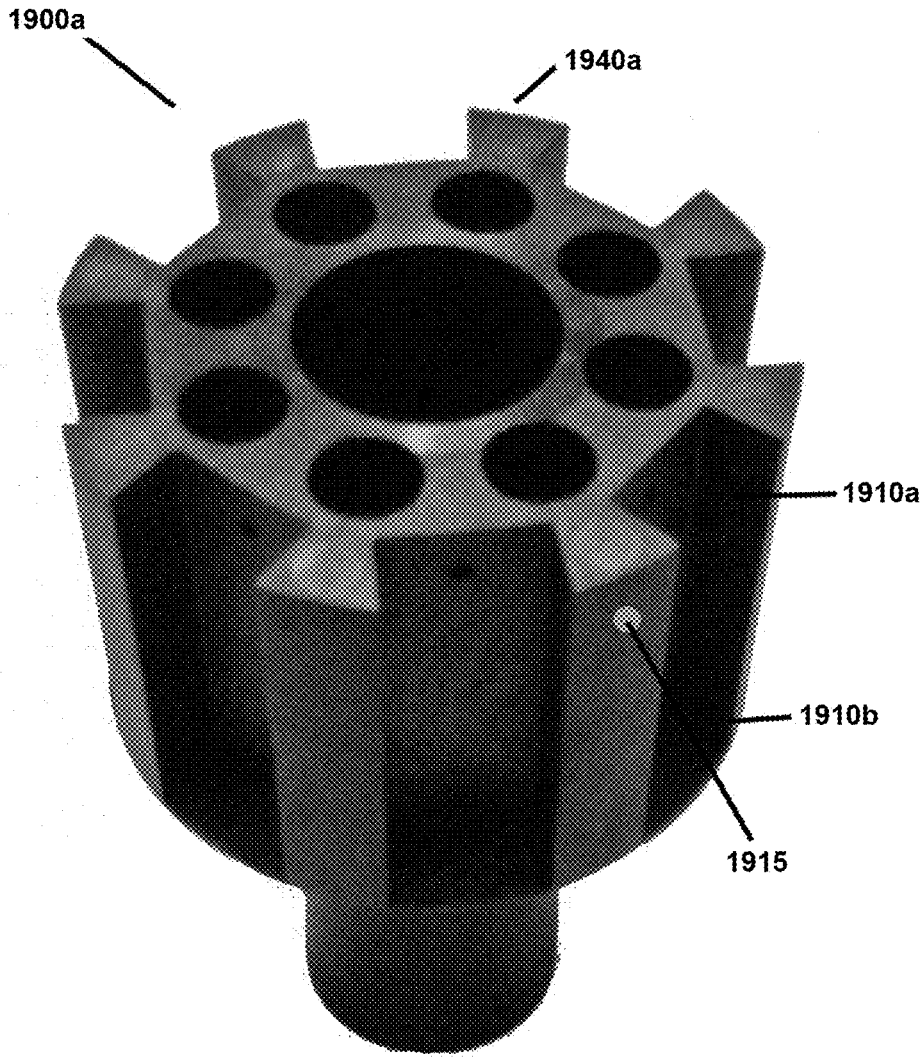
FIG. 32 shows a hub assembly.
Figure 33:
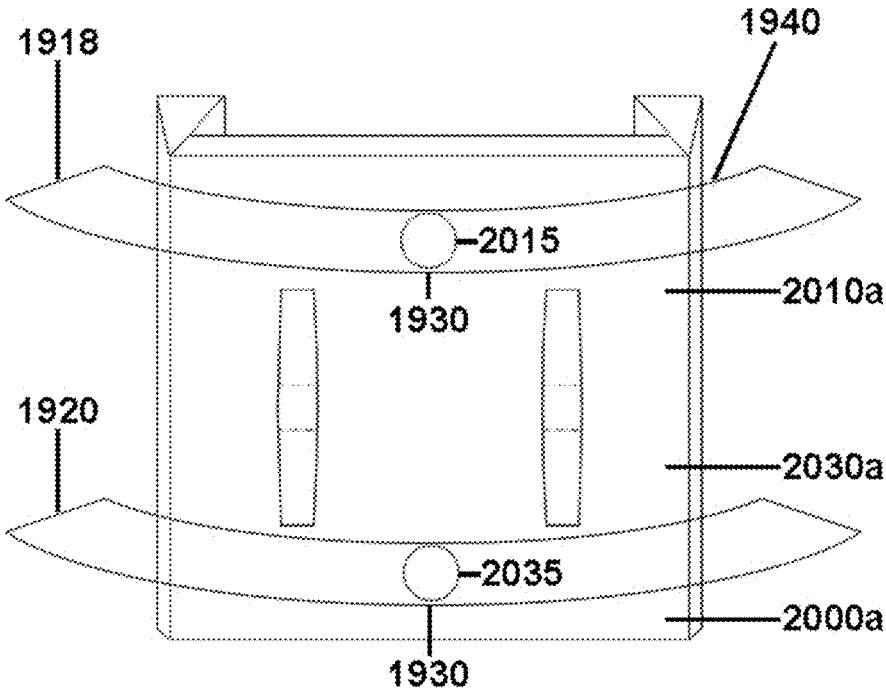
FIG. 33 shows mortise-tenon mounting bracket in combination with a securing ring.

Shown in FIGS. 32-33 are an alternate mortise-tenon ringed hub assembly (1900*a*), a mortise-tenon mounting bracket (2000*a*), a first securing ring 1918, and a second securing ring 1920. The first securing ring (1918) is positioned at a first region (1910*a*) of a mortise-tenon ringed hub assembly (1900*a*) and a first region (2010*a*) of the mortise-tenon mounting bracket (2000*a*), and a second securing ring (1920) positioned at a second region (1910*b*) of the mortise-tenon ringed hub assembly (1900*a*) and a mortise-tenon mounting assembly third region (2030*a*). Mortise-tenon mounting ringed hub assembly (1900*b*) is not shown and is the same as mortise-tenon ringed hub assembly (1900*a*). The applicable features and elements of the preferred embodiment of the instant invention as well as the other alternate embodiments disclosed herein are understood as being applicable to this embodiment.

Each securing ring (1918, 1920) includes holes (1930) (preferably recessed) positioned around the circumference of each securing ring (1918, 1920) at positions aligned with the mortise-tenon hub assembly extensions (1940*a*) and the first region and/or third region mounting assembly screw holes (2015, 2035).

Each securing ring (1918, 1920) further includes securing ring screws (not shown) inserted into the securing ring holes (1930) aligned with and extending through the respective first region and/or third region mounting assembly screw hole (2015, 2035) into the applicable hub assembly extensions (1940*a*). Each securing ring (1918, 1920) includes an inner surface (1940) which abuts the respective first region (2010*a*) and/or the third region (2030*a*) of each mortise-tenon mounting bracket (2000*a*).

The securing rings (1918, 1920) secure the mortise-tenon mounting bracket (2000*a*) to the mortise-tenon hub assembly (1900*a*) and preferably the width of the outer circumference of securing rings (1918, 1920) is selected to the prevent an umbrella rib and its associated components from pivoting beyond the periphery of the securing ring (1918, 1920).

For mortise-tenon ringed hub assembly (1900*a*), the mortise-tenon mounting bracket (2000*a*) includes at least one mounting assembly screw which fixably mounts the mortise-tenon umbrella hub assembly (1900*a*) onto the pole (101) at the pole first end (101*a*).

For mortise-tenon ringed hub assembly (1900*b*) and the mortise-tenon mounting bracket (2000*b*), which are similar to the mortise-tenon ringed hub assembly (1900*a*) and the mortise-tenon mounting bracket (2000*a*), the mounting assembly screw does not extend through the pole through-hole (101*d*) at a pole first end (101*a*) and into at least one finial stem guide threaded through hole (735). This allows mortise-tenon mounting bracket (2000*b*) to be slidably repositioned on the pole (101) while still employing the securing rings (1918, 1920) to secure the mortise-tenon mounting bracket (2000*b*) to the mortise-tenon ringed hub assembly (1900*a*).

In operation from the closed or stored position, the user grasps the second hub assembly handle (230*b*) and slides the second hub assembly (230*b*) along the pole (101) towards the first hub assembly (230*a*) until the desired position is reached.

The desired position may correspond to a particular tautness of the fabric (120) or to an aesthetic appear for the umbrella assembly. Once the desired position is reached, the user inserts the pole pin (102*a*) into the selected pole height hole (102) thereby securing the umbrella in the desired open position.

Since the height holes (102) are provided at varying distances along the pole (101) the user can readjust the open position of the umbrella assembly as needed, such as if the fabric (120) begins to sag or droop due to age and wear.

The elements and components of the instant invention may be made of any appropriately suitable material including but not limited to wood, plastic, metal, high strength composites and fibers, fiberglass, etc.

While various embodiments of the present invention have been shown and described herein, it will be obvious that such embodiments are provided by way of example only. Numerous variations, changes and substitutions may be made without departing from the invention herein. Accordingly, it is intended that the invention be limited only by the spirit and scope of the appended claims.

What is claimed is:

1. A rib center joint member for an umbrella comprising:

a monolithic elongated member having a proximal end and a distal end and at least one opening extending at least partially along a length thereof;

two parallel extensions extending outward from the monolithic elongated member and configured to engage a lower rib; and a portion projecting outward from the monolithic elongated member and at least partially disposed inbetween the two parallel extensions to limit rotation of the lower rib towards the distal end of the monolithic elongated member during closing of the umbrella by making contact with the lower rib.

2. The rib center joint member according to claim 1, further comprising:

a rib connector rotatably attached to the two parallel extensions at a first end, the rib connector having an opening extending into and along a length of the rib connector from a second end to engage a rib, wherein the projecting portion engages and prevents the rib connector from rotating relative to the monolithic elongated member such that the opening of the monolithic elongated member and the rib connector are parallel to one another.

3. The rib center joint member according to claim 1, wherein the at least one opening extends the length of the monolithic elongated member.

4. The rib center joint member according to claim 1, further comprising a second portion projecting radially outward from the monolithic elongated member, the two portions disposed adjacent opposite ends of the monolithic elongated member.

5. The rib center joint member according to claim 1, wherein the two parallel extensions extend directly from the monolithic elongated member.

6. The rib center joint member according to claim 1, wherein the two parallel extensions are integral with the monolithic elongated member.

7. A rib center joint member for an umbrella comprising:

a seamless cylindrical member having a proximal end and a distal end and at least one opening extending at least partially along a length thereof;

two extensions extending radially outward from the seamless cylindrical member and configured to engage a lower rib; and at least one portion projecting outward from the seamless cylindrical member and at least partially disposed inbetween the two extensions to limit rotation of the lower rib towards the distal end of the seamless cylindrical member during closing of the umbrella by making contact with the lower rib.

8. The rib center joint member according to claim 7, wherein the at least one portion projecting outward comprises two portions, each of the two portions disposed adjacent respective ends of the seamless cylindrical member.

9. The rib center joint member according to claim 7, wherein the at least one opening extends the length of the seamless cylindrical member.

10. A rib center joint assembly for an umbrella comprising:

a rib center joint, the rib center joint comprising an monolithic elongated member having at least one opening extending at least partially along a length thereof, two parallel extensions extending outward from the monolithic elongated member;

a rib connector rotatably attached at a first end to the two parallel extensions of the rib center joint, the rib connector having an opening extending into and along a length of the rib connector from a second end;

a radially projecting portion disposed on one of the rib center joint and the rib connector, the radially projecting portion to limit rotation of the rib connector relative to the monolithic elongated member such that the opening of the monolithic elongated member and the rib connector are not parallel to one another in a closed position, the radially projecting portion being at least partially disposed inbetween the two parallel extensions in the closed position.

11. A rib center joint member for an umbrella comprising:

a monolithic elongated member having an outer surface, a proximal end, and a distal end and at least one opening extending at least partially along a length thereof;

two parallel extensions extending outward from the monolithic elongated member and configured to engage a lower rib, the parallel extensions defining a space therebetween, at least two outwardly facing surfaces disposed at least partially within the space, a first of the at least two outwardly facing surfaces being radially outward of the other of the at least two outwardly facing surfaces, wherein the first of the at least two outwardly facing surfaces limits rotation of the lower rib towards the distal end of the monolithic elongated member during closing of the umbrella by making contact with the lower rib.

12. The rib center joint member according to claim 11, wherein the two parallel extensions extend directly from the monolithic elongated member.

13. The rib center joint member according to claim 11, wherein the two parallel extensions are integral with the monolithic elongated member.

14. A rib center joint assembly for an umbrella comprising:

a rib center joint, the rib center joint comprising an seamless elongated member having at least one opening extending at least partially along a length thereof, two parallel extensions extending outward from the seamless elongated member;

a rib connector rotatably attached at a first end to the two parallel extensions of the rib center joint, the rib connector having an opening extending into and along a length of the rib connector from a second end;

a radially projecting portion disposed on one of the rib center joint and the rib connector, the radially projecting portion to limit rotation of the rib connector relative to the seamless elongated member such that the opening of the seamless elongated member and the rib connector are not parallel to one another in a closed position, the radially projecting portion being at least partially disposed inbetween the two parallel extensions in the closed position.

* * * * *